US010811203B2

(12) United States Patent
Morita

(10) Patent No.: US 10,811,203 B2
(45) Date of Patent: Oct. 20, 2020

(54) SWITCHING DEVICE

(71) Applicant: Sony Corporation, Tokyo (JP)

(72) Inventor: Tadashi Morita, Tokyo (JP)

(73) Assignee: Sony Corporation, Tokyo (JP)

( * ) Notice: Subject to any disclaimer, the term of this patent is extended or adjusted under 35 U.S.C. 154(b) by 475 days.

(21) Appl. No.: 15/566,045

(22) PCT Filed: Jul. 9, 2015

(86) PCT No.: PCT/JP2015/069773
§ 371 (c)(1),
(2) Date: Oct. 12, 2017

(87) PCT Pub. No.: WO2016/170699
PCT Pub. Date: Oct. 27, 2016

(65) Prior Publication Data

US 2018/0138000 A1 May 17, 2018

(30) Foreign Application Priority Data

Apr. 20, 2015 (JP) ..... 2015-085692
Jun. 2, 2015 (JP) ..... 2015-112047
Jun. 19, 2015 (JP) ..... 2015-123422

(51) Int. Cl.
*H01H 47/00* (2006.01)
*H01H 9/54* (2006.01)
*H01H 47/22* (2006.01)

(52) U.S. Cl.
CPC ..... *H01H 47/001* (2013.01); *H01H 9/542* (2013.01); *H01H 47/223* (2013.01); *H01H 2009/546* (2013.01)

(58) Field of Classification Search
CPC ..... H01H 47/001; H01H 9/542
See application file for complete search history.

(56) References Cited

U.S. PATENT DOCUMENTS 3,651,374 A 3/1972 Faust
4,445,183 A * 4/1984 McCollum ..... H02H 3/0935 361/13

(Continued)

FOREIGN PATENT DOCUMENTS

CN 203325804 U 12/2013
DE 2946895 A1 5/1981

(Continued)

OTHER PUBLICATIONS

International Search Report and Written Opinion and English translation thereof dated Sep. 15, 2015 in connection with International Application No. PCT/JP2015/069773.

(Continued)

*Primary Examiner* — Scott Bauer
(74) *Attorney, Agent, or Firm* — Wolf, Greenfield & Sacks, P.C.

(57) ABSTRACT

The present disclosure proposes a switching device which, when supplying and interrupting power by combining a mechanical relay with a solid-state relay, suppresses the effects of chattering from the mechanical relay, and thus makes it possible to stably supply and interrupt power. Provided is the switching device including: a semiconductor relay configured to switch between supplying and interrupting power from a power supply; a mechanical relay configured to be connected in parallel to the semiconductor relay and connected at one end to a control terminal of the semiconductor relay; and a switch configured to switch between supplying and interrupting current to the semiconductor relay. The semiconductor relay turns on by high voltage being applied to the control terminal after current flows through a coil of the mechanical relay and a contact is switched, and the semiconductor relay turns off by low voltage being applied to the control terminal after current (Continued)

stops flowing through the coil of the mechanical relay and the contact is switched.

21 Claims, 34 Drawing Sheets

(56) References Cited

U.S. PATENT DOCUMENTS

| | | | | |
|---|---|---|---|---|
| 5,536,980 | A | 7/1996 | Kawate et al. | |
| 5,699,218 | A | 12/1997 | Kadah | |
| 6,046,899 | A * | 4/2000 | Dougherty | H01H 9/542 361/104 |
| 6,621,668 | B1 * | 9/2003 | Sare | H01H 9/542 361/13 |
| 7,385,791 | B2 * | 6/2008 | Ness | H01H 50/541 361/8 |
| 2001/0035755 | A1 | 11/2001 | Shirato | |
| 2003/0193770 | A1 | 10/2003 | Chung | |
| 2004/0165322 | A1 * | 8/2004 | Crawford | H01H 9/542 361/2 |

FOREIGN PATENT DOCUMENTS

| | | | |
|---|---|---|---|
| FR | 2538608 | A1 | 6/1984 |
| JP | 02-012119 | A | 1/1990 |
| JP | 02-165533 | A | 6/1990 |
| JP | 08-153439 | A | 6/1996 |
| JP | 09-007473 | A | 1/1997 |
| JP | 2001-283703 | A | 10/2001 |
| JP | 2003-338239 | A | 11/2003 |
| JP | 2005-019106 | A | 1/2005 |
| JP | 2005-100924 | A | 4/2005 |
| JP | 2014-157768 | A | 8/2014 |
| WO | WO 86/01334 | A1 | 2/1986 |

OTHER PUBLICATIONS

International Preliminary Report on Patentability and English translation thereof dated Nov. 2, 2017 in connection with International Application No. PCT/JP2015/069773.

Extended European Search Report dated Nov. 29, 2018 in connection with European Application No. 15889938.5.

Chinese Office Action dated Oct. 19, 2018 in connection with Chinese Application No. 201580078791.2 and English translation thereof.

* cited by examiner

SWITCHING DEVICE

CROSS-REFERENCE TO RELATED APPLICATIONS

This application claims the benefit under 35 U.S.C. § 371 as a U.S. National Stage Entry of International Application No. PCT/JP2015/069773, filed in the Japanese Patent Office as a Receiving Office on Jul. 9, 2015, which claims priority to Japanese Patent Application Number JP2015-123422, filed in the Japanese Patent Office on Jun. 19, 2015, Japanese Patent Application Number JP2015-112047, filed in the Japanese Patent Office on Jun. 2, 2015, and Japanese Patent Application Number JP2015-085692, filed in the Japanese Patent Office on Apr. 20, 2015, each of which is hereby incorporated by reference in its entirety.

TECHNICAL FIELD

The present disclosure relates to a switching device.

BACKGROUND ART

Technology that combines a mechanical relay with a solid-state relay (SSR, semiconductor relay) in order to switch between supplying and interrupting power from a power supply has been disclosed (see, for example, Patent Literature 1 and 2 and the like).

CITATION LIST

Patent Literature

Patent Literature 1: JP 2005-100924A
Patent Literature 2: JP 2003-338239A

DISCLOSURE OF INVENTION

Technical Problem

In a case where power is supplied and interrupted by combining a mechanical relay with a solid-state relay, it is necessary to take into account chattering from the mechanical relay.

Therefore, the present disclosure proposes a novel and improved switching device which, when supplying and interrupting power by combining a mechanical relay with a solid-state relay, suppresses the effects of chattering from the mechanical relay, and thus makes it possible to stably supply and interrupt power.

Solution to Problem

According to the present disclosure, there is provided a switching device including: a semiconductor relay configured to switch between supplying and interrupting power from a power supply; a mechanical relay configured to be connected in parallel to the semiconductor relay to switch between supplying and interrupting power from the power supply, and connected at one end to a control terminal of the semiconductor relay; and a switch configured to switch between supplying and interrupting current to the semiconductor relay. The semiconductor relay turns on by high voltage being applied to the control terminal after current flows through a coil of the mechanical relay and a contact is switched, and the semiconductor relay turns off by low voltage being applied to the control terminal after current stops flowing through the coil of the mechanical relay and the contact is switched.

In addition, according to the present disclosure, there is provided a switching device including: a first semiconductor relay configured to switch between supplying and interrupting power from a first power supply; a second semiconductor relay configured to switch between supplying and interrupting power from a second power supply; a first mechanical relay configured to be connected in parallel to the first semiconductor relay to switch between supplying and interrupting power from the first power supply; a second mechanical relay configured to be connected in parallel to the second semiconductor relay to switch between supplying and interrupting power from the second power supply; a first flip-flop circuit configured to control operation of the first mechanical relay and the second mechanical relay; and a second flip-flop circuit configured to output high or low voltage to a control terminal of the first semiconductor relay and a control terminal of the second semiconductor relay. After current has stopped flowing to one of the first mechanical relay or the second mechanical relay, the first flip-flop circuit passes current to the other, and the second flip-flop circuit inverts output to the control terminal of the first semiconductor relay and the control terminal of the second semiconductor relay after current has stopped flowing to one of the first mechanical relay or the second mechanical relay.

In addition, according to the present disclosure, there is provided a switching device including: a first semiconductor relay configured to switch between supplying and interrupting power from a first alternating-current power supply; a second semiconductor relay configured to switch between supplying and interrupting power from a second alternating-current power supply; a first mechanical relay configured to be connected in parallel to the first semiconductor relay to switch between supplying and interrupting power from the first alternating-current power supply; a second mechanical relay configured to be connected in parallel to the second semiconductor relay to switch between supplying and interrupting power from the second alternating-current power supply; a first flip-flop circuit configured to control operation of the first mechanical relay and the second mechanical relay; a second flip-flop circuit configured to output high or low voltage to a control terminal of the first semiconductor relay and a control terminal of the second semiconductor relay; a first trigger circuit configured to generate a first trigger signal using output of the first alternating-current power supply; and a second trigger circuit configured to generate a second trigger signal using output of the second alternating-current power supply. After current has stopped flowing to one of the first mechanical relay or the second mechanical relay, the first flip-flop circuit passes current to the other. The second flip-flop circuit feeds back output to output of the first flip-flop circuit, and inverts output to the control terminal of the first semiconductor relay and the control terminal of the second semiconductor relay on the basis of the first trigger signal or the second trigger signal, after current has stopped flowing to one of the first mechanical relay or the second mechanical relay and current flows to the other.

In addition, according to the present disclosure, there is provided a switching device including: a semiconductor relay configured to switch between supplying and interrupting power from a power supply; a mechanical relay configured to be connected in parallel to the semiconductor relay to switch between supplying and interrupting power from the power supply; and a capacitor configured to be connected in parallel to the mechanical relay and connected at one end to a control terminal of the semiconductor relay. The semiconductor relay turns on by high voltage being applied to the control terminal before the mechanical relay switches from off to on, and the semiconductor relay turns off by low voltage being applied to the control terminal after the mechanical relay has switched from on to off. The capacitor stores power while the mechanical relay is on, and the capacitor outputs power to keep the semiconductor relay on after the mechanical relay has switched off.

Advantageous Effects of Invention

As described above, according to the present disclosure, it is possible to provide a switching device which, when supplying and interrupting power by combining a mechanical relay with a solid-state relay, suppresses the effects of chattering from the mechanical relay, and thus makes it possible to stably supply and interrupt power.

Note that the effects described above are not necessarily limitative. With or in the place of the above effects, there may be achieved any one of the effects described in this specification or other effects that may be grasped from this specification.

MODE(S) FOR CARRYING OUT THE INVENTION

Figure 1:
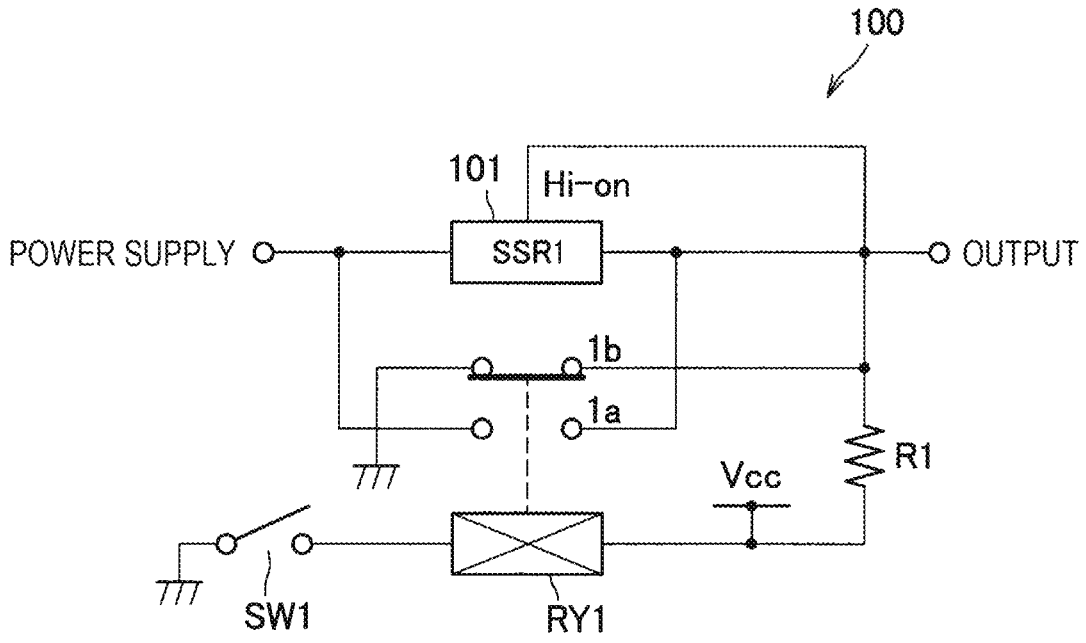
FIG. 1 is an explanatory view illustrating a configuration example of a switching device 100 according to an embodiment of the present disclosure.

Hereinafter, (a) preferred embodiment(s) of the present disclosure will be described in detail with reference to the appended drawings. In this specification and the appended drawings, structural elements that have substantially the same function and structure are denoted with the same reference numerals, and repeated explanation of these structural elements is omitted.

Note that the description will be given in the following order.

1. Embodiment of present disclosure
1.1. Background
1.2. Configuration examples
2. Summary

1. Embodiment of Present Disclosure

1.1. Background

Before describing an embodiment of the present disclosure in detail, the background of the embodiment of the present disclosure will be described.

There exists technology using a solid-state relay (SSR) in order to switch between supplying and interrupting power from a direct-current power supply or an alternating-current power supply. When switching between supplying and interrupting power from a power supply is performed using an SSR, a voltage drop occurs when the SSR is on. For example, if a load of 50 A continues to be applied when a voltage drop of approximately 1.6 V occurs due to the SSR in a case where the SSR is on, a power consumption of 1.6 V×50 A=80 W will occur in the SSR. The SSR will then generate heat due to this power consumption. In order to dissipate the heat generated by the SSR, it is necessary to provide a heat dissipation mechanism, but this heat dissipation mechanism will end up increasing the size of the device.

Therefore, technology that connects a mechanical relay in parallel to the SSR to suppress power consumption by the SSR, as well as heat generation in the SSR that accompanies this power consumption, has been proposed. However, chattering occurs in a mechanical relay when switching contacts. Patent Literature 1 discloses technology that delays the switching of a mechanical relay by a predetermined period of time to suppress the effects of chattering that occurs in the mechanical relay. However, delaying the switching of the mechanical relay by a predetermined period of time results in the switching taking a long period of time, so that much more heat is also generated by the SSR.

Therefore, in view of the background described above, the disclosing party of the present disclosure has intensively studied technology to keep chattering generated when switching contacts in a mechanical relay from affecting switching, in a case where a mechanical relay is connected in parallel to an SSR in order to switch between suppling and interrupting power from a power supply. As a result, the disclosing party of the present disclosure has devised technology to keep chattering generated when switching contacts in a mechanical relay from affecting switching, by switching the SSR on and off in conjunction with the switching of the contacts in the mechanical relay, in a case where a mechanical relay is connected in parallel to an SSR in order to switch between supplying and interrupting power from a power supply, as described below.

Heretofore, the background of the embodiment of the present disclosure has been described. Continuing on, an embodiment of the present disclosure will be described.

1.2. Configuration Examples

FIG. 1 is an explanatory view illustrating a configuration example of a switching device 100 according to an embodiment of the present disclosure. The switching device 100 illustrated in FIG. 1 is a device that switches between supplying and interrupting power from a power supply (e.g., a direct-current power supply that outputs direct-current power). As illustrated in FIG. 1, the switching device 100 according to an embodiment of the present disclosure includes a solid-state relay (SSR) 101, a mechanical relay RY1, and a switch SW1.

The SSR 101 is a contactless relay that uses a semiconductor. In the switching device 100 illustrated in FIG. 1, the SSR 101 is provided in a power supply path from the power supply to an output terminal. In the embodiment, the SSR 101 is configured to turn on when high voltage is applied to a control terminal, and turn off when low voltage is applied to the control terminal.

The mechanical relay RY1 is a relay that has two contacts 1*a* and 1*b*. When the switch SW1 is turned on (closed), current flows through a coil provided inside the mechanical relay RY1, and the mechanical relay RY1 switches to connect to the contact 1*a* due to electromagnetic force created by that current. Also, when the switch SW1 is turned off (open), current stops flowing through the coil provided inside the mechanical relay RY1, and the mechanical relay RY1 automatically switches to connect to the contact 1*b* due to the loss of the electromagnetic force. That is, the mechanical relay RY1 is an automatic reset relay in which current flows from the power supply to the output terminal, bypassing the SSR 101, when the switch SW1 is turned on and the mechanical relay RY1 is connected to the contact 1*a*.

The switch SW1 is a switch that controls the operation of the mechanical relay RY1. When the switch SW1 is turned on, current from a power supply $V_{SS}$ flows to the mechanical relay RY1, and current flows through the coil of the mechanical relay RY1. When current flows through the coil of the mechanical relay RY1, the mechanical relay RY1 switches to connect to the contact 1*a* due to the electromagnetic force generated by that current. When the mechanical relay RY1 switches to connect to the contact 1*a*, a high potential from the power supply $V_{SS}$ is applied to the control terminal of the SSR 101 through a resistor R1, and when the high potential from the power supply $V_{SS}$ is applied to the control terminal of the SSR 101, the SSR 101 turns on.

On the other hand, when the switch SW1 is turned off, current from the power supply $V_{SS}$ stops flowing to the mechanical relay RY1, such that current stops flowing through the coil of the mechanical relay RY1. When current stops flowing through the coil of the mechanical relay RY1, the mechanical relay RY1 loses the electromagnetic force generated by that current, and consequently switches to connect to the contact 1*b*. When the mechanical relay RY1 switches to connect to the contact 1*b*, a low potential is applied to the control terminal of the SSR 101, and when the low potential is applied to the control terminal of the SSR 101, the SSR 101 turns off.

Figure 2:
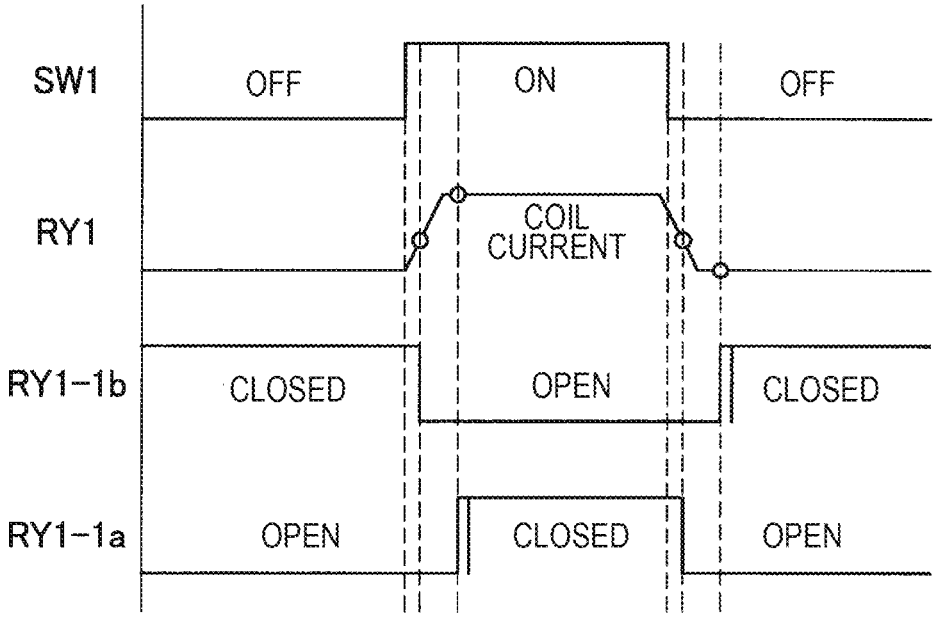
FIG. 2 is a timing chart illustrating operation of the switching device 100 illustrated in FIG. 1.

FIG. 2 is a timing chart illustrating operation of the switching device 100 illustrated in FIG. 1. As described above, in a case where the switch SW1 is off, current is not flowing to the mechanical relay RY1, so the mechanical relay RY1 is connected to the contact 1*b*. Therefore, the contact 1*b* of the mechanical relay RY1 is closed and the contact 1*a* is open.

When the switch SW1 switches from off to on, the mechanical relay RY1 gradually generates electromagnetic force. When the electromagnetic force generated by the mechanical relay RY1 reaches a certain degree, the mechanical relay RY1 breaks the connection with the contact 1*b*. When the electromagnetic force increases further, the mechanical relay RY1 connects to the contact 1*a*. Note that chattering occurs when the mechanical relay RY1 connects to the contact 1*a*. When the mechanical relay RY1 switches to connect to the contact 1*a*, a high potential from the power supply $V_{SS}$ is applied to the control terminal of the SSR 101 through the resistor R1, and when the high potential from the power supply $V_{SS}$ is applied to the control terminal of the SSR 101, the SSR 101 turns on.

On the other hand, when the switch SW1 switches from on to off, the mechanical relay RY1 gradually reduces the electromagnetic force. When the electromagnetic force generated by the mechanical relay RY1 starts to decrease, the mechanical relay RY1 breaks the connection with the contact 1*a*. When the electromagnetic force decreases further, the mechanical relay RY1 connects to the contact 1*b*, but chattering occurs when connecting to this contact 1*b*.

Here, when the mechanical relay RY1 breaks the connection with the contact 1*a*, originally an arc would be generated. However, the switching device 100 connects the SSR 101 and the mechanical relay RY1 in parallel, so the SSR 101 is still kept on immediately after the mechanical relay RY1 breaks the connection with the contact 1*a*. Therefore, with the switching device 100 illustrated in FIG. 1, arcing can be inhibited even if the switch SW1 switches from on to off and the mechanical relay RY1 breaks the connection with the contact 1*a*.

With the switching device 100 illustrated in FIG. 1, arcing can be inhibited even if the mechanical relay RY1 breaks the connection with the contact 1*a*. However, chattering occurs when the mechanical relay RY1 connects to the contacts 1*a* and 1*b*. Although there is no particular problem with chattering when the mechanical relay RY1 connects to the contact 1*a*, chattering that occurs when the mechanical relay RY1 connects to the contact 1*b* becomes chattering of a potential that is applied to the control terminal of the SSR 101, and also ends up leading to chattering in which the SSR 101 switches on and off repeatedly in a short period of time.

Therefore, a configuration example of the switching device 100 that improves upon the switching device illustrated in FIG. 1 by eliminating the effects of chattering when the mechanical relay RY1 connects to the contact 1*b* will be described below.

Figure 3:
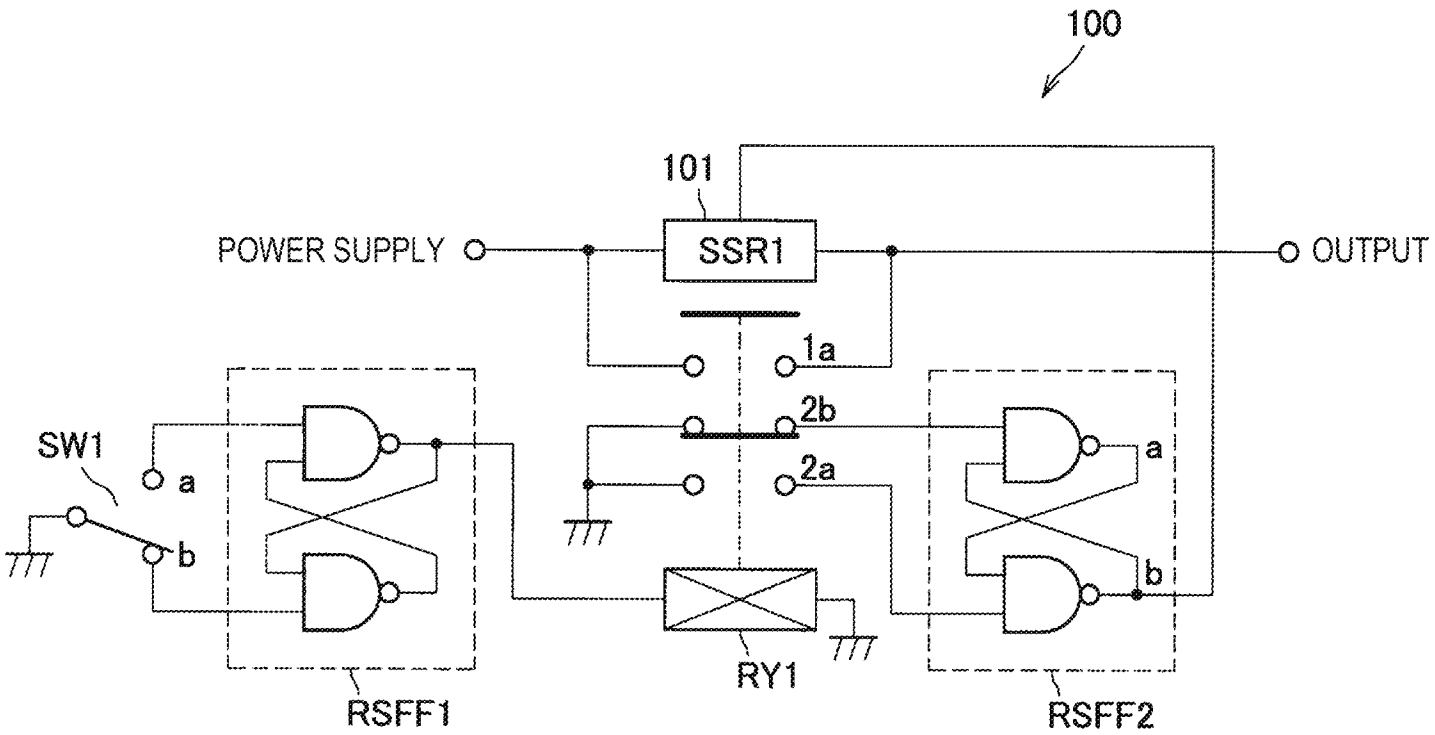
FIG. 3 is an explanatory view illustrating a configuration example of a switching device 100 according to an embodiment of the present disclosure.

FIG. 3 is an explanatory view illustrating a configuration example of the switching device 100 according to an embodiment of the present disclosure. The switching device 100 illustrated in FIG. 3 is a device that switches between supplying and interrupting power from a power supply (e.g., a direct-current power supply that outputs direct-current power). This switching device 100 is characterized in that the number of contacts of the mechanical relay RY1 is increased to three, and an RS flip-flop circuit RSFF1 is connected between the mechanical relay RY1 and the switch SW1, and an RS flip-flop circuit RSFF2 is connected between the mechanical relay RY1 and the SSR 101.

The mechanical relay RY1 of the switching device 100 illustrated in FIG. 3 has three contacts 1*a*, 2*a*, and 2*b*. The mechanical relay RY1 is an automatic reset relay which, when current flows through the coil, operates so as to switch to connect to the contacts 1*a* and 2*a* due to the electromagnetic force generated by the current, and when current stops flowing through the coil, operates so as to switch to automatically connect to the contact 2*b* due to the loss of electromagnetic force.

The RS flip-flop circuit RSFF1 is an RS-type flip-flop circuit that controls the operation of the mechanical relay RY1. The RS flip-flop circuit RSFF1 provided between the switch SW1 and the mechanical relay RY1 is designed to absorb chattering of the switch SW1. Also, the RS flip-flop circuit RSFF2 is a circuit that controls the operation of the SSR 101.

Figure 4:
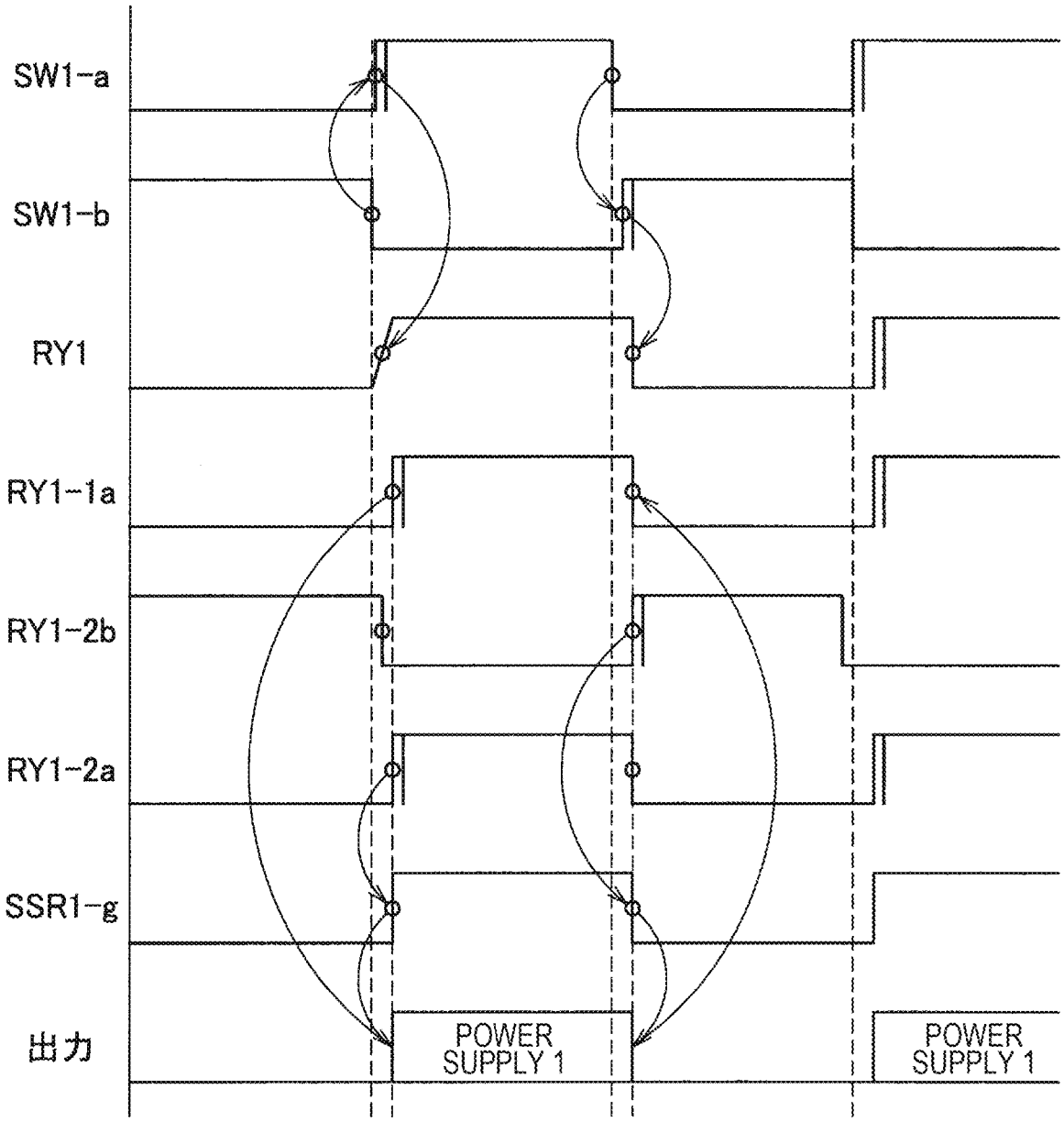
FIG. 4 is a timing chart illustrating operation of the switching device 100 illustrated in FIG. 3.

FIG. 4 is a timing chart illustrating operation of the switching device 100 illustrated in FIG. 3. Hereinafter, the operation of the switching device 100 illustrated in FIG. 3 will be described using the timing chart in FIG. 4.

In a state in which the switch SW1 is connected to a contact b, the RS flip-flop circuit RSFF1 outputs a low potential, so current does not flow through the mechanical relay RY1. Because current is not flowing through the mechanical relay RY1, the mechanical relay RY1 is connected to the contact 2*b*. Therefore, the contact 2*b* of the mechanical relay RY1 is closed and the contacts 1*a* and 2*a* are open.

When the switch SW1 switches so as to move away from the contact b and connect to a contact a, the RS flip-flop circuit RSFF1 outputs a high potential to the mechanical relay RY1 and current flows through the mechanical relay RY1. The mechanical relay RY1 gradually generates electromagnetic force due to the current output from the RS flip-flop circuit RSFF1. When the electromagnetic force generated by the mechanical relay RY1 reaches a certain degree, the mechanical relay RY1 breaks the connection with the contact 2*b*. When the electromagnetic force increases further, the mechanical relay RY1 connects to the contacts 1*a* and 2*a*, but chattering occurs when connecting to these contacts 1*a* and 2*a*.

When the mechanical relay RY1 switches to connect to the contact 2*a*, a high potential is applied from the power supply $V_{SS}$ to the control terminal of the SSR 101, and when the high potential from the power supply $V_{SS}$ is applied to the control terminal of the SSR 101, the SSR 101 turns on. As a result of the SSR 101 turning on, power from a power supply 1 is output from an output terminal. Although chattering does occur when the mechanical relay RY1 connects to the contacts 1*a* and 2*a*, the output of power is not interrupted because the SSR 101 is on, as described above. Also, the SSR 101 that is on is short-circuited due to the mechanical relay RY1 being connected to the contact 1*a*, so heat generation in the SSR 101 is suppressed.

On the other hand, when the switch SW1 switches so as to move away from the contact a and connect to the contact b, the RS flip-flop circuit RSFF1 outputs a low potential, so current stops flowing through the mechanical relay RY1. Because the RS flip-flop circuit RSFF1 stops the current from flowing through the mechanical relay RY1, the mechanical relay RY1 gradually decreases the electromagnetic force. When the mechanical relay RY1 starts to decrease the electromagnetic force, the mechanical relay RY1 breaks the connection with the contacts 1*a* and 2*a*. When the mechanical relay RY1 decreases the electromagnetic force further, the mechanical relay RY1 connects to the contact 2*b*, but chattering occurs when connecting to this contact 2*b*.

Here, when the mechanical relay RY1 breaks the connection with the contacts 1*a* and 2*a*, originally an arc would be generated. However, the switching device 100 connects the SSR 101 and the mechanical relay RY1 in parallel, so the SSR 101 is still kept on immediately after the mechanical relay RY1 breaks the connection with the contacts 1*a* and 2*a*. Therefore, with the switching device 100 illustrated in FIG. 3, arcing can be inhibited even if the switch SW1 switches so as to move away from the contact a and connect to the contact b, and the mechanical relay RY1 breaks the connection with the contacts 1*a* and 2*a*.

Figure 5:
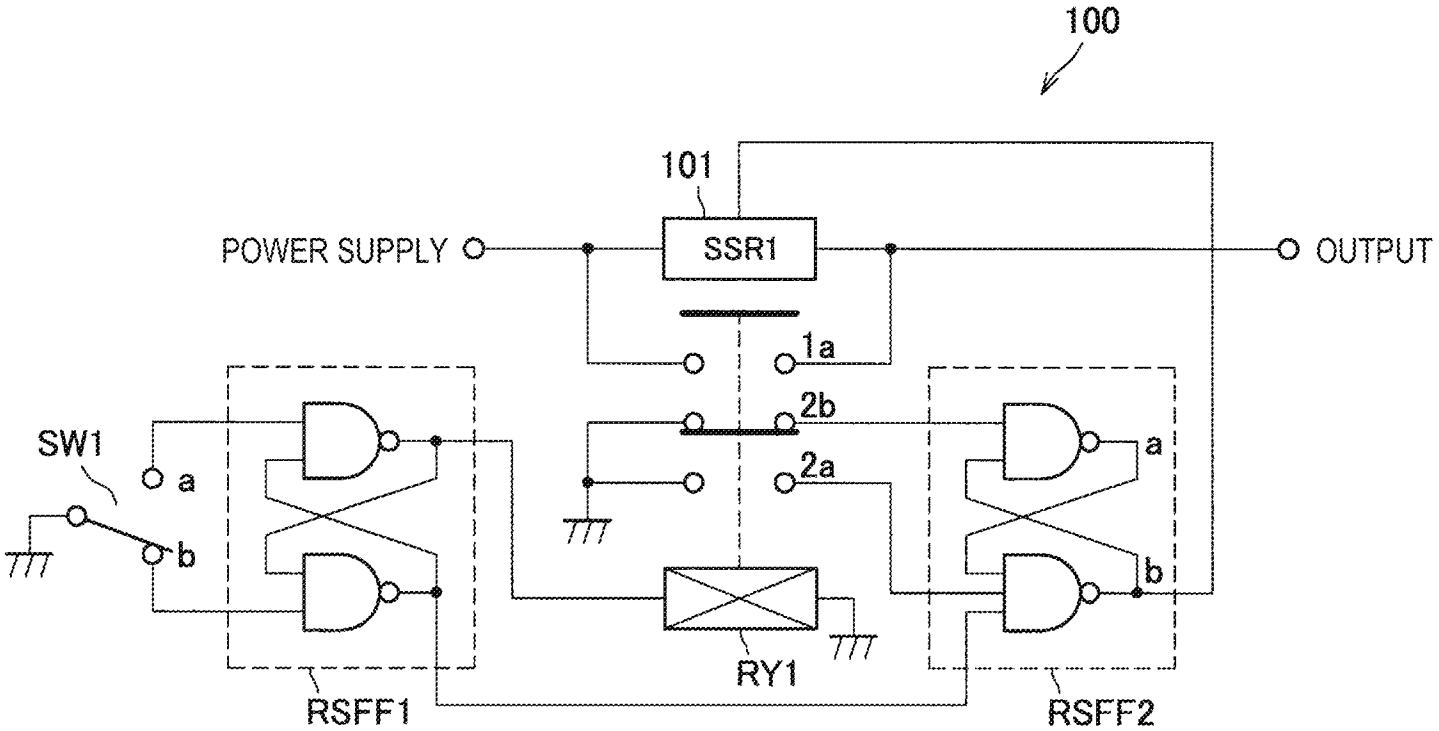
FIG. 5 is an explanatory view illustrating a configuration example of a switching device 100 according to an embodiment of the present disclosure.

FIG. 5 is an explanatory view illustrating a configuration example of the switching device 100 according to an embodiment of the present disclosure. The switching device 100 illustrated in FIG. 5 is a device that switches between supplying and interrupting power from a power supply (e.g., a direct-current power supply that outputs direct-current power). In a way similar to the switching device illustrated in FIG. 3, the switching device 100 illustrated in FIG. 5 is characterized in that the number of contacts of the mechanical relay RY1 is increased to three, and an RS flip-flop circuit RSFF1 is connected between the mechanical relay RY1 and the switch SW1, and an RS flip-flop circuit RSFF2 is connected between the mechanical relay RY1 and the SSR 101. Furthermore, the switching device 100 illustrated in FIG. 5 inputs the output of the RS flip-flop circuit RSFF1 to the RS flip-flop circuit RSFF2. By inputting the output of the RS flip-flop circuit RSFF1 to the RS flip-flop circuit RSFF2, the timing at which the SSR 101 is turned on can be made earlier when the switch SW1 switches so as to move away from the contact b and connect to the contact a.

That is, the switching device 100 illustrated in FIG. 5 is a device that turns the SSR 101 on beforehand, even if the timing at which the mechanical relay RY1 connects to the contact 1*a* and the contact 2*a* is off, when the switch SW1 switches so as to move away from the contact b and connect to the contact a. By turning on the SSR 101 in advance when the switch SW1 switches so as to move away from the contact b and connect to the contact a, the switching device 100 illustrated in FIG. 5 is able to inhibit sparking when the mechanical relay RY1 connects to the contact 1*a* and the contact 2*a*.

What has been illustrated up to this point is a configuration example of the switching device 100 that switches between outputting and interrupting power from a single power supply. Continuing on, a configuration example of a switching device 100 that switches so as to output power from one of two power supplies will be described.

Figure 6:
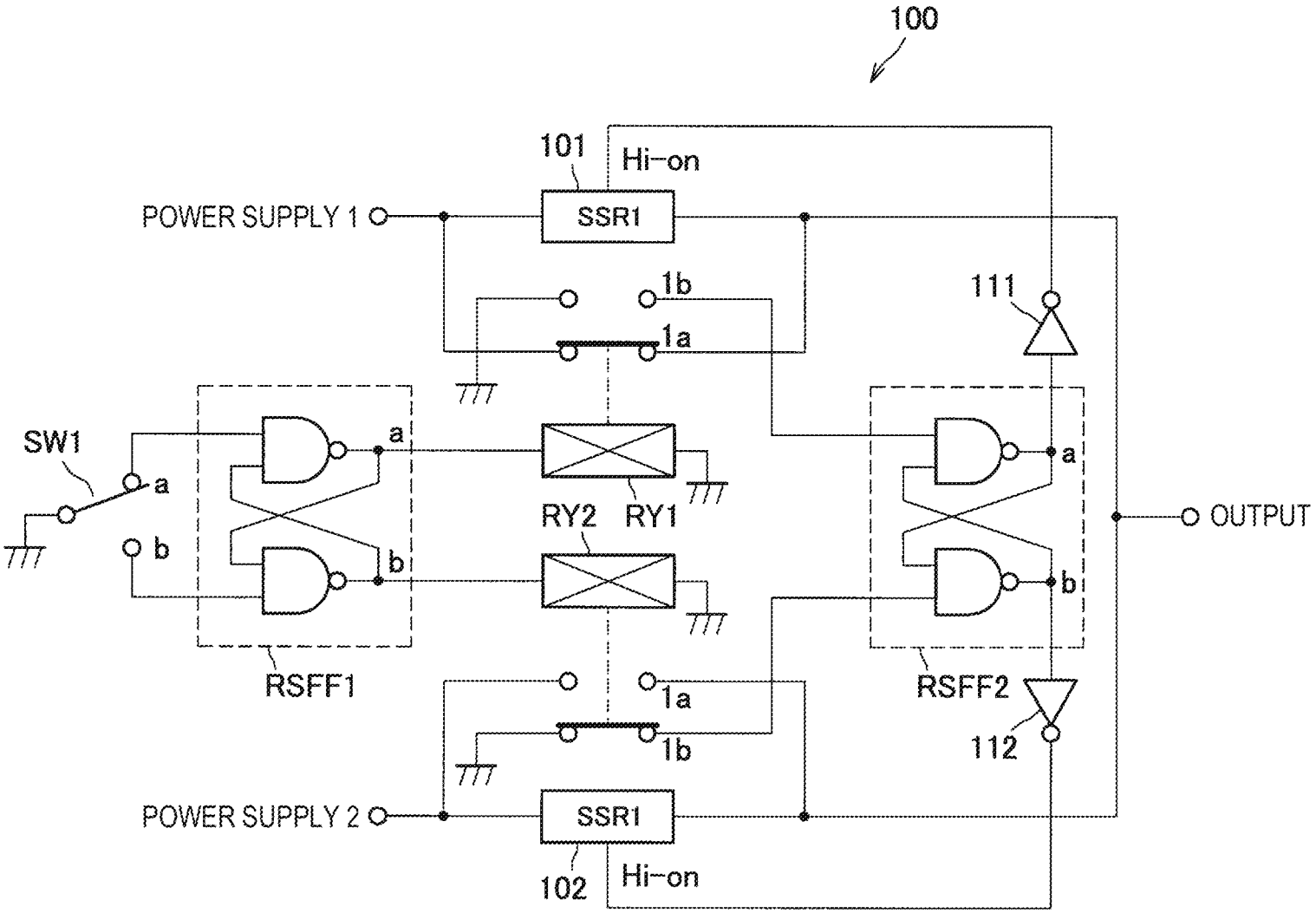
FIG. 6 is an explanatory view illustrating a configuration example of a switching device 100 according to an embodiment of the present disclosure.

FIG. 6 is an explanatory view illustrating a configuration example of a switching device 100 according to an embodiment of the present disclosure. The switching device 100 illustrated in FIG. 6 is a device that switches so as to output power from one of two power supplies 1 and 2.

The switching device 100 illustrated in FIG. 6 includes SSRs 101 and 102, mechanical relays RY1 and R2, a switch SW1, RS flip-flop circuits RSFF1 and RSFF2, and inverters 111 and 112.

The switch SW1 in FIG. 6 is a switch for switching the power supply that outputs power from the switching device 100. The switching device 100 outputs power from a power supply 1 in a state in which the switch SW1 is connected to a contact a, and outputs power from a power supply 2 in a state in which the switch SW1 is connected to a contact b. The power supply 1 and the power supply 2 are both direct-current power supplies that supply direct-current power, for example.

The RS flip-flop circuit RSFF1 provided between the switch SW1 and the mechanical relays RY1 and R2 is designed to absorb the chattering of the switch SW1. The RS flip-flop circuit RSFF1 outputs current to the mechanical relays RY1 and R2 to drive the mechanical relays RY1 and R2. Also, the RS flip-flop circuit RSFF2 provided downstream of the mechanical relays RY1 and R2 is a circuit that controls the operation of the SSRs 101 and 102.

As a switching characteristic of the mechanical relays RY1 and R2 of the switching device 100 illustrated in FIG. 6, it is assumed that switching is performed at almost the same time for both make and break.

Figure 7:
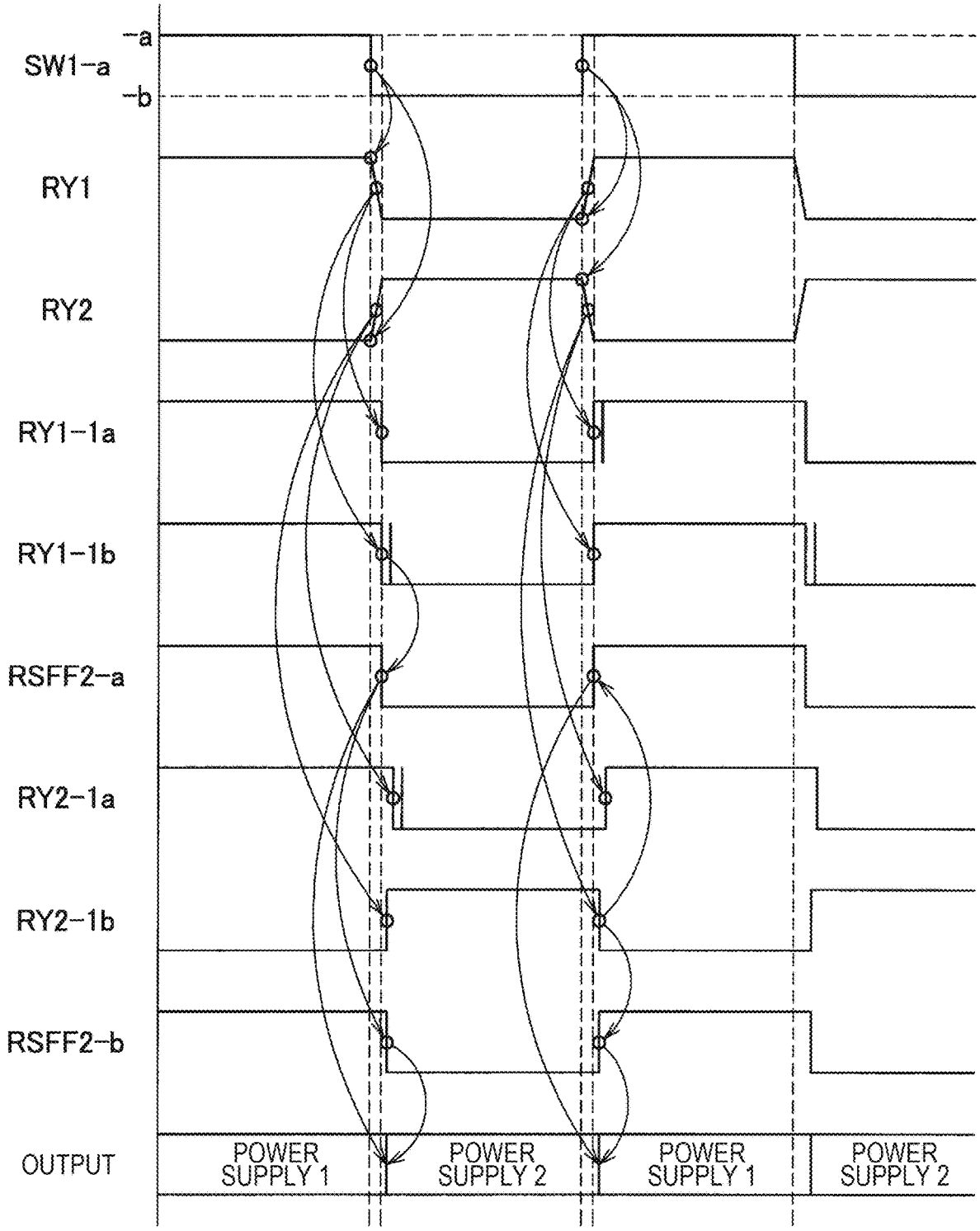
FIG. 7 is a timing chart illustrating operation of the switching device 100 illustrated in FIG. 6.

FIG. 7 is a timing chart illustrating operation of the switching device 100 illustrated in FIG. 6. Hereinafter, the operation of the switching device 100 illustrated in FIG. 6 will be described using the timing chart in FIG. 7.

In a state in which the switch SW1 is connected to the contact a, output on the a-side of the RS flip-flop circuit RSFF1 is high, and output on the b-side of the RS flip-flop circuit RSFF1 is low. As a result of the output on the a-side of the RS flip-flop circuit RSFF1 being high, current flows to the mechanical relay RY1, but current does not flow to the mechanical relay RY2.

Because current is flowing through the mechanical relay RY1, the mechanical relay RY1 is connected to the contact 1*a*. Also, because current is flowing through the mechanical relay RY2, the mechanical relay RY2 is connected to the contact 1*a*. Because the mechanical relay RY1 is connected to the contact 1*a*, the contact 1*b* is not grounded. Therefore, a high potential is output to the RS flip-flop circuit RSFF2 from the contact 1*b* of the mechanical relay RY1. Because the mechanical relay RY2 is connected to the contact 1*b*, the contact 1*b* is grounded. Therefore, a low potential is output to the RS flip-flop circuit RSFF2 from the contact 1*b* of the mechanical relay RY2.

The RS flip-flop circuit RSFF2 outputs a low state from the a-side and a high state from the b-side. The inverters 111 and 112 are provided downstream of the RS flip-flop circuit RSFF2, so the outputs of the RS flip-flop circuit RSFF2 are each inverted and supplied to the SSRs 101 and 102. Therefore, a high potential is supplied to the SSR 101 and a low potential is supplied to the SSR 102. The SSR 101 is on and the SSR 102 is off, so the switching device 100 illustrated in FIG. 6 outputs power from the power supply 1.

When the switch SW1 switches so as to move away from the contact a and connect to the contact b from this state, the RS flip-flop circuit RSFF1 gradually passes current through the mechanical relay RY2, and the mechanical relay RY2 gradually generates electromagnetic force by the current output from the RS flip-flop circuit RSFF1. When the electromagnetic force generated by the mechanical relay RY2 reaches a certain degree, the mechanical relay RY2 breaks the connection with the contact 1*b*. When the electromagnetic force increases further, the mechanical relay RY2 connects to the contact 1*a*, but chattering occurs when connecting to this contact 1*a*. However, when the mechanical relay RY2 connects to the contact 1*a*, power has already started to be output via the SSR 102, so even if chattering occurs when the mechanical relay RY2 connects to the contact 1*a*, the output side will not become unstable.

On the other hand, the RS flip-flop circuit RSFF1 gradually stops the current from flowing through the mechanical relay RY1, so the mechanical relay RY1 gradually decreases the electromagnetic force. When the electromagnetic force generated by the mechanical relay RY1 starts to decrease, the mechanical relay RY1 breaks the connection with the contact 1*a*. When the electromagnetic force decreases further, the mechanical relay RY1 connects to the contact 1*b*, but chattering occurs when connecting to this contact 1*b*.

A characteristic of the mechanical relay is that the reset time of the contact is shorter than the driving time. Therefore, the switching device 100 illustrated in FIG. 6 operates such that when the switch SW1 switches so as to move away from the contact a and connect to the contact b, the mechanical relay RY1 first connects to the contact b, and then the mechanical relay RY2 connects to the contact a. That is, with the switching device 100 illustrated in FIG. 6, when the switch SW1 switches so as to move away from the contact a and connect to the contact b, the switching device 100 switches to output power from the power supply 2.

When the mechanical relay RY1 breaks the connection with the contact 1*a*, originally an arc would be generated. However, the switching device 100 illustrated in FIG. 6 connects the SSR 101 and the mechanical relay RY1 in parallel, so the SSR 101 is still kept on immediately after the mechanical relay RY1 breaks the connection with the contact 1*a*. Therefore, with the switching device 100 illustrated in FIG. 6, arcing can be prevented even if the switch SW1 switches so as to move away from the contact a and connect to the contact b, and the mechanical relay RY1 breaks the connection with the contact 1*a*.

The switching device 100 performs a similar operation also in a case where the switch SW1 switches so as to move away from the contact b and connect to the contact a. That is, the switching device 100 illustrated in FIG. 6 operates such that when the switch SW1 switches so as to move away from the contact b and connect to the contact a, the mechanical relay RY2 first connects to the contact b, and then the mechanical relay RY1 connects to the contact a.

When the mechanical relay RY2 breaks the connection with the contact 1*a*, originally an arc would be generated. However, the switching device 100 illustrated in FIG. 6 connects the SSR 102 and the mechanical relay RY2 in parallel, so the SSR 102 is still kept on immediately after the mechanical relay RY2 breaks the connection with the contact 1*a*. Therefore, with the switching device 100 illustrated in FIG. 6, arcing can be suppressed even if the switch SW1 switches so as to move away from the contact b and connect to the contact a, and the mechanical relay RY2 breaks the connection with the contact 1*a*.

The switching device 100 illustrated in FIG. 6 is able to both continue to stably output power by absorbing chattering in the mechanical relays RY1 and RY2, and suppress arcing in the mechanical relays RY1 and RY2, even when the connection of the switch SW1 switches between the contact a and the contact b.

Figure 8:
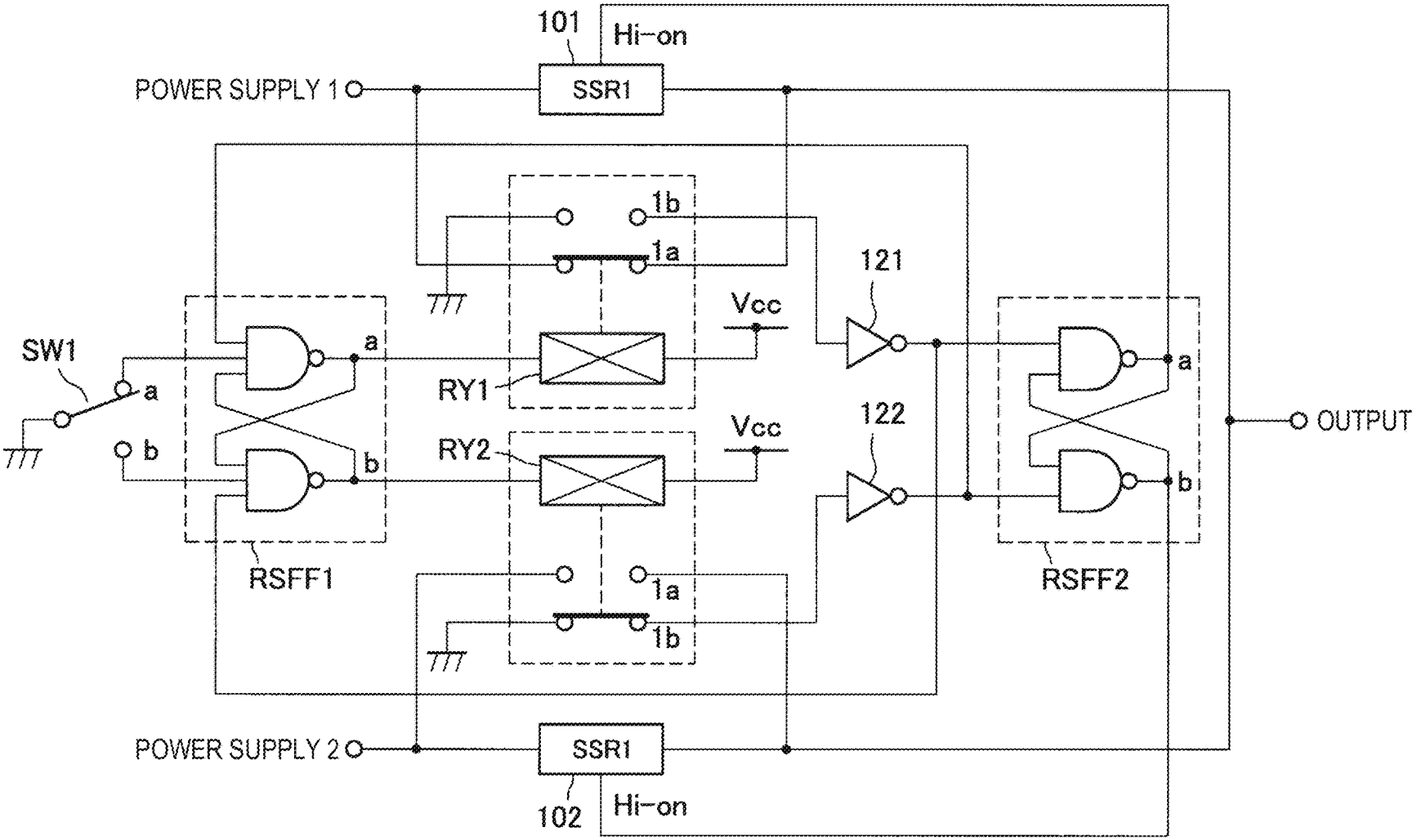
FIG. 8 is an explanatory view illustrating a configuration example of a switching device 100 according to an embodiment of the present disclosure.

FIG. 8 is an explanatory view illustrating a configuration example of a switching device 100 according to an embodiment of the present disclosure. The switching device 100 illustrated in FIG. 8 is a device that switches so as to output power from one of two power supplies 1 and 2.

The switching device 100 illustrated in FIG. 8 includes SSRs 101 and 102, mechanical relays RY1 and R2, a switch SW1, RS flip-flop circuits RSFF1 and RSFF2, and inverters 121 and 122.

The RS flip-flop circuit RSFF1 illustrated in FIG. 8 is configured such that output from the switch SW1, output of an opposing NAND gate, and a signal from a break contact of an opposing relay are input, and output switches depending on the state of these inputs. The switching device 100 illustrated in FIG. 8 links operating signals of the mechanical relays RY1 and R2 with the switching of the switch SW1. The switching device 100 illustrated in FIG. 8 realizes a reliable switching sequence, even in a case where the operating times of the mechanical relays RY1 and R2 are significantly off, by inputting the signal from the break contact of the relay opposite the RS flip-flop circuit RSFF1.

Figure 9:
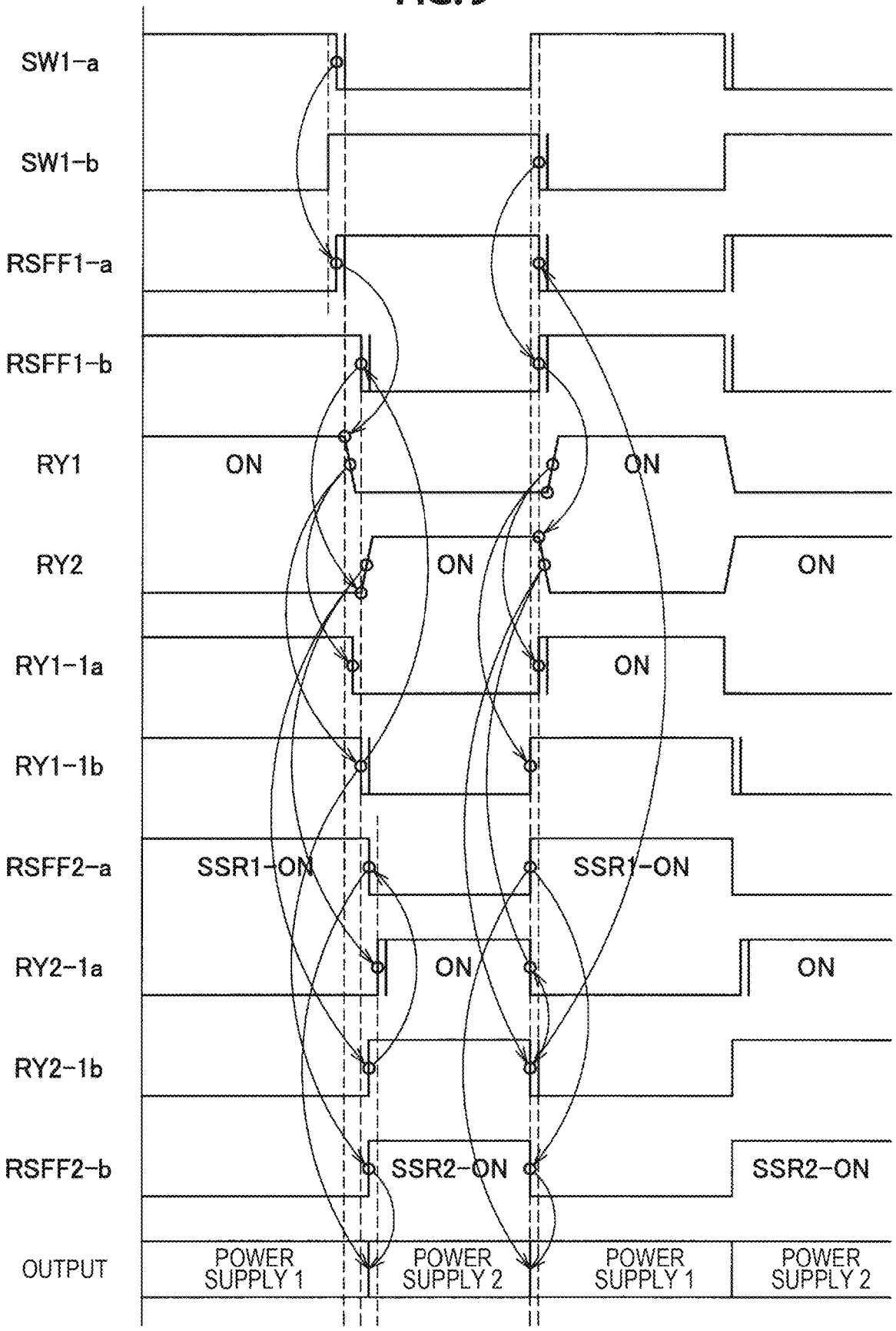
FIG. 9 is a timing chart illustrating operation of the switching device 100 illustrated in FIG. 8.

FIG. 9 is a timing chart illustrating operation of the switching device 100 illustrated in FIG. 8. Hereinafter, the operation of the switching device 100 illustrated in FIG. 8 will be described using the timing chart in FIG. 9.

When the switch SW1 illustrated in FIG. 8 is connected to the contact a, the switching device 100 turns the SSR 101 on as the output on the a-side of the RS flip-flop circuit RSFF2 is high because the contact 1*b* of the mechanical relay RY1 is open. The switching device 100 turns the SSR 102 off as the output on the b-side of the RS flip-flop circuit RSFF2 is low because the contact 1*b* of the mechanical relay RY2 is closed. The switching device 100 outputs power from the power supply 1 by passing current through the mechanical relay RY1 and turning on the SSR 101, when the switch SW1 illustrated in FIG. 8 is connected to the contact a.

When the switch SW1 illustrated in FIG. 8 switches so as to move away from the contact a and connect to the contact b from this state, the RS flip-flop circuit RSFF1 gradually passes current through the mechanical relay RY2, and the mechanical relay RY2 gradually generates electromagnetic force by the current output from the RS flip-flop circuit RSFF1. When the electromagnetic force generated by the mechanical relay RY2 reaches a certain degree, the mechanical relay RY2 breaks the connection with the contact 1*b*. When the electromagnetic force increases further, the mechanical relay RY2 connects to the contact 1*a*, but chattering occurs when connecting to this contact 1*a*. However, when the mechanical relay RY2 connects to the contact 1*a*, power has already started to be output via the SSR 102, so even if chattering occurs when the mechanical relay RY2 connects to the contact 1*a*, the output side will not become unstable.

On the other hand, the RS flip-flop circuit RSFF1 gradually stops the current from flowing through the mechanical relay RY1, so the mechanical relay RY1 gradually decreases the electromagnetic force. When the electromagnetic force generated by the mechanical relay RY1 starts to decrease, the mechanical relay RY1 breaks the connection with the contact 1*a*. When the electromagnetic force decreases further, the mechanical relay RY1 connects to the contact 1*b*, but chattering occurs when connecting to this contact 1*b*.

When the mechanical relays RY1 and RY2 switch contacts, chattering occurs with the contact on the contacting side, but chattering does not occur with the contact on the separating side. Therefore, the switching device 100 illustrated in FIG. 8 is configured such that the output state of the RS flip-flop circuit RSFF1 switches in response to a signal from the contact that performs the separation operation first. The chattering due to contact of the mechanical relays RY1 and RY2 is included in the activation time of the SSRs 101 and 102, so the switching device 100 illustrated in FIG. 8 is such that chattering of the mechanical relays RY1 and RY2 will not affect the output of power.

Similarly, arcing originally occurs upon separation of the contacts of the mechanical relays RY1 and RY2 is also absorbed within the operating time of the SSRs 101 and 102, so the switching device 100 illustrated in FIG. 8 is able to prevent arcing.

Moreover, even if the operating time of the mechanical relays RY1 and RY2 changes due to aging, the RS flip-flop circuit RSFF1 is activated on the basis of operation of the mechanical relays RY1 and RY2, so the switching device 100 illustrated in FIG. 8 will not be affected by a change in the mechanical relays RY1 and RY2 due to aging.

Figure 10:
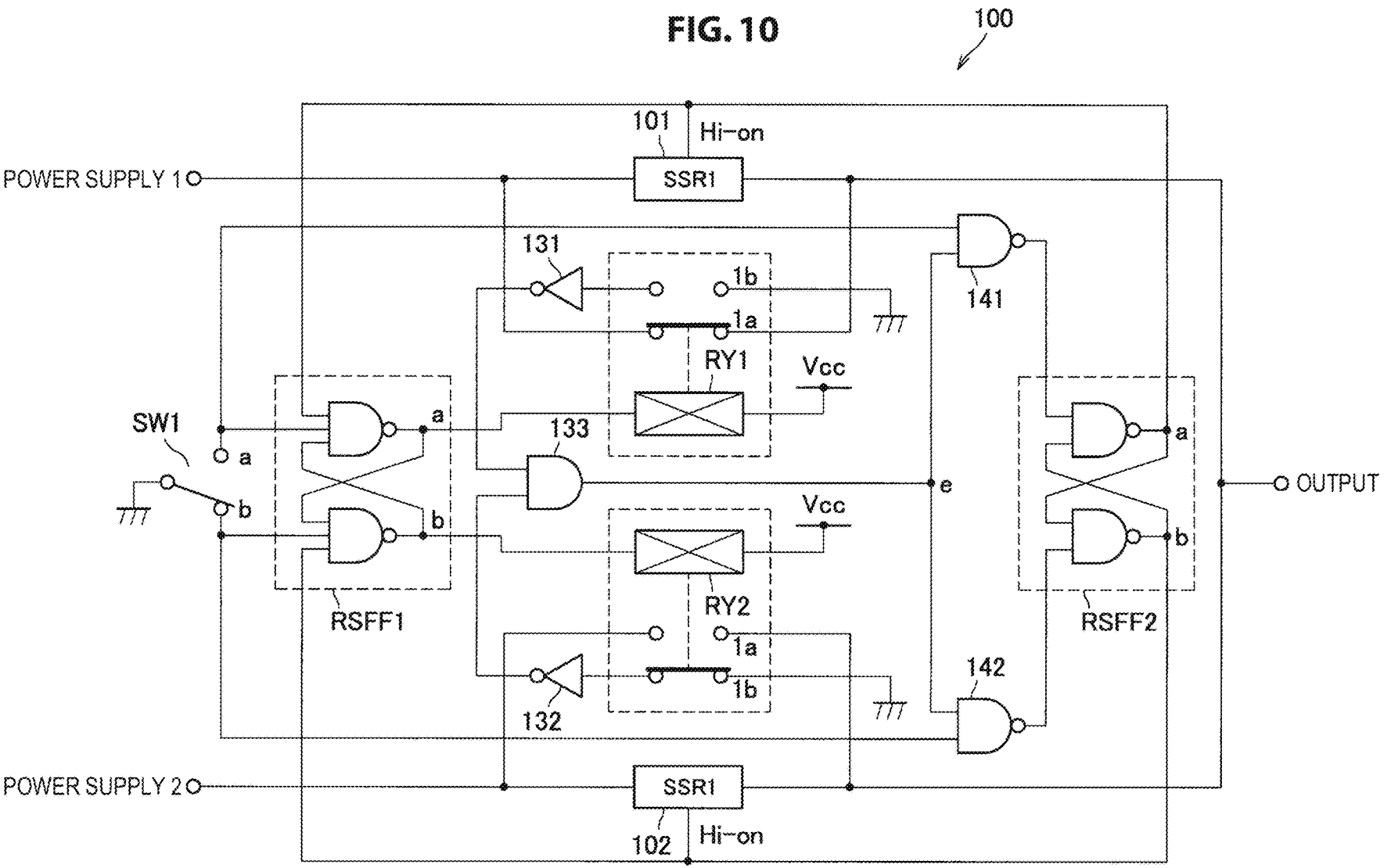
FIG. 10 is an explanatory view illustrating a configuration example of a switching device 100 according to an embodiment of the present disclosure.

FIG. 10 is an explanatory view illustrating a configuration example of a switching device 100 according to an embodiment of the present disclosure. The switching device 100 illustrated in FIG. 10 is a device that switches so as to output power from one of two power supplies 1 and 2.

The switching device 100 illustrated in FIG. 10 includes SSRs 101 and 102, mechanical relays RY1 and RY2, a switch SW1, RS flip-flop circuits RSFF1 and RSFF2, inverters 131 and 132, an AND gate 133, and NAND gates 141 and 142.

The RS flip-flop circuit RSFF1 illustrated in FIG. 10 is configured such that output from the switch SW1, output of the opposing NAND gate, and a signal from the RS flip-flop circuit RSFF2 are input, and output switches depending on the state of these inputs. The inverters 131 and 132 invert the outputs of the contacts 1*b* of the mechanical relays RY1 and RY2, respectively. By passing the outputs of the contacts 1*b* of the mechanical relays RY1 and RY2 output via the inverters 131 and 132, through the AND gate 133, the switching device 100 illustrated in FIG. 10 is able control the operation of the RS flip-flop circuit RSFF2 such that neither of the outputs from the RS flip-flop circuit RSFF2 becomes high, by switching the state of the RS flip-flop circuit RSFF2 while the mechanical relays RY1 and RY2 are simultaneously off, i.e., connected to the contacts 1*b*.

Figure 11:
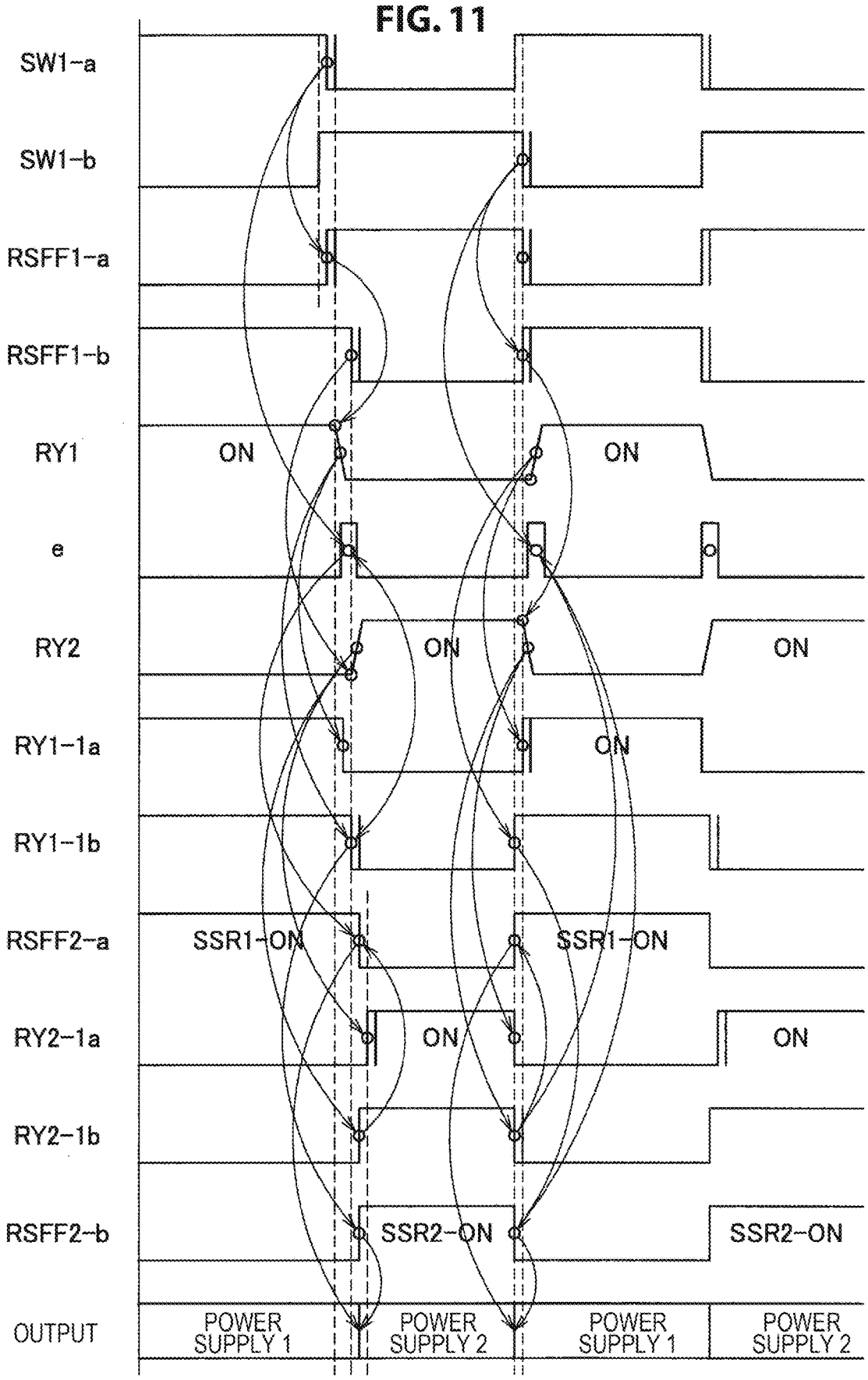
FIG. 11 is a timing chart illustrating operation of the switching device 100 illustrated in FIG. 10.

FIG. 11 is a timing chart illustrating operation of the switching device 100 illustrated in FIG. 10. Hereinafter, the operation of the switching device 100 illustrated in FIG. 10 will be described using the timing chart in FIG. 11.

When the switch SW1 illustrated in FIG. 10 is connected to the contact a, the switching device 100 is such that the contact 1*b* of the mechanical relay RY1 is open, so the output (the state of point e in the configuration in FIG. 10) of the AND gate 133 is low, and the outputs of the NAND gates 141 and 142 become high. As a result, the switching device 100 illustrated in FIG. 10 turns the SSR 101 on because the output on the a-side of the RS flip-flop circuit RSFF2 becomes high. Also, the switching device 100 illustrated in FIG. 10 turns the SSR 102 off because the output on the b-side of the RS flip-flop circuit RSFF2 becomes low. The switching device 100 outputs power from the power supply 1 by passing current through the mechanical relay RY1 and turning on the SSR 101, when the switch SW1 illustrated in FIG. 10 is connected to the contact a.

When the switch SW1 illustrated in FIG. 10 switches so as to move away from the contact a and connect to the contact b from this state, the RS flip-flop circuit RSFF1 gradually passes current through the mechanical relay RY2, and the mechanical relay RY2 gradually generates electromagnetic force by the current output from the RS flip-flop circuit RSFF1. When the electromagnetic force generated by the mechanical relay RY2 reaches a certain degree, the mechanical relay RY2 breaks the connection with the contact 1*b*.

On the other hand, the RS flip-flop circuit RSFF1 gradually stops the current from flowing through the mechanical relay RY1, so the mechanical relay RY1 gradually decreases the electromagnetic force. When the electromagnetic force generated by the mechanical relay RY1 starts to decrease, the mechanical relay RY1 breaks the connection with the contact 1*a*. When the electromagnetic force decreases further, the mechanical relay RY1 connects to the contact 1*b*.

Here, in the switching device 100 in FIG. 10, the mechanical relays RY1 and RY2 are simultaneously off, i.e., are both connected to the contacts 1*b*, so the output of the AND gate 133 at this timing becomes high. As a result, the switching device 100 illustrated in FIG. 10 turns the SSR 101 off because the output on the a-side of the RS flip-flop circuit RSFF2 becomes low. Then after the SSR 101 has been turned off, the switching device 100 illustrated in FIG. 10 turns the SSR 102 on because the output on the b-side of the RS flip-flop circuit RSFF2 becomes high.

Then, when only the mechanical relay RY1 is turned off, i.e., when only the mechanical relay RY1 is connected to the contact 1*b*, the output of the AND gate 133 becomes low.

The switching device 100 illustrated in FIG. 10 is able to both continue to stably output power by absorbing chattering in the mechanical relays RY1 and RY2, and suppress arcing in the mechanical relays RY1 and RY2, even when the connection of the switch SW1 switches between the contact a and the contact b.

Also, the switching device 100 illustrated in FIG. 10 transmits the output of the switch SW1 to the RS flip-flop circuit RSFF2 after confirming that the mechanical relays RY1 and RY2 are off at the same time, and is thus able to control the operation of the RS flip-flop circuit RSFF2 such that neither of the outputs of the RS flip-flop circuit RSFF2 will be high. That is, the switching device 100 illustrated in FIG. 10 is able to prevent power from being output from the two power supplies 1 and 2 simultaneously, by transmitting the output of the switch SW1 to the RS flip-flop circuit RSFF2 after confirming that the mechanical relays RY1 and RY2 are off at the same time.

Figure 12:
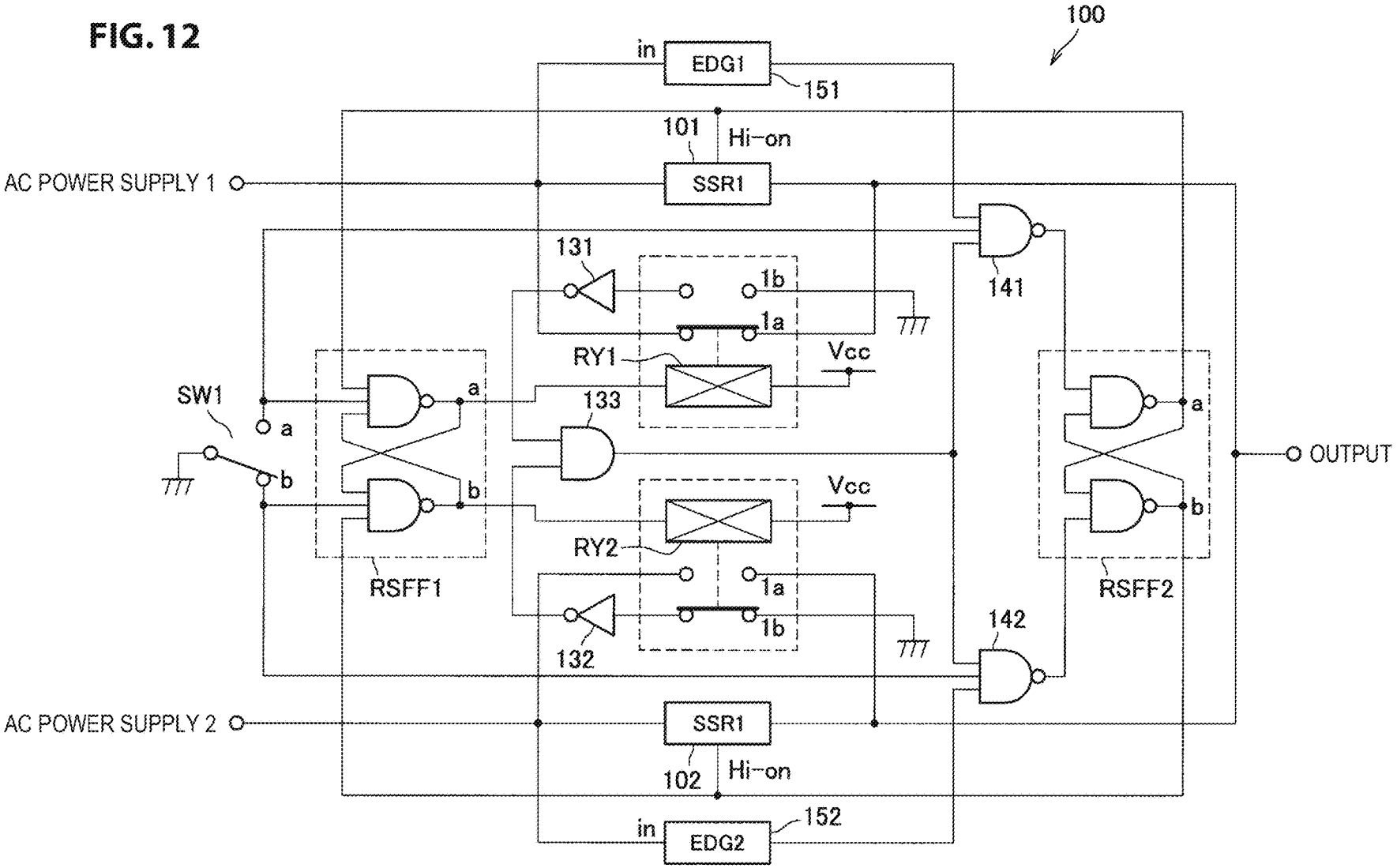
FIG. 12 is an explanatory view illustrating a configuration example of a switching device 100 according to an embodiment of the present disclosure.

FIG. 12 is an explanatory view illustrating a configuration example of a switching device 100 according to an embodiment of the present disclosure. The switching device 100 illustrated in FIG. 12 is a device that switches so as to output power from one of alternating-current (AC) power supplies 1 and 2.

The switching device 100 illustrated in FIG. 12 includes SSRs 101 and 102, mechanical relays RY1 and RY2, a switch SW1, RS flip-flop circuits RSFF1 and RSFF2, inverters 131 and 132, an AND gate 133, NAND gates 141 and 142, and trigger signal generation units (EDG) 151 and 152. Note that the SSRs 101 and 102 in FIG. 12 are zero cross control relays.

Figure 13:
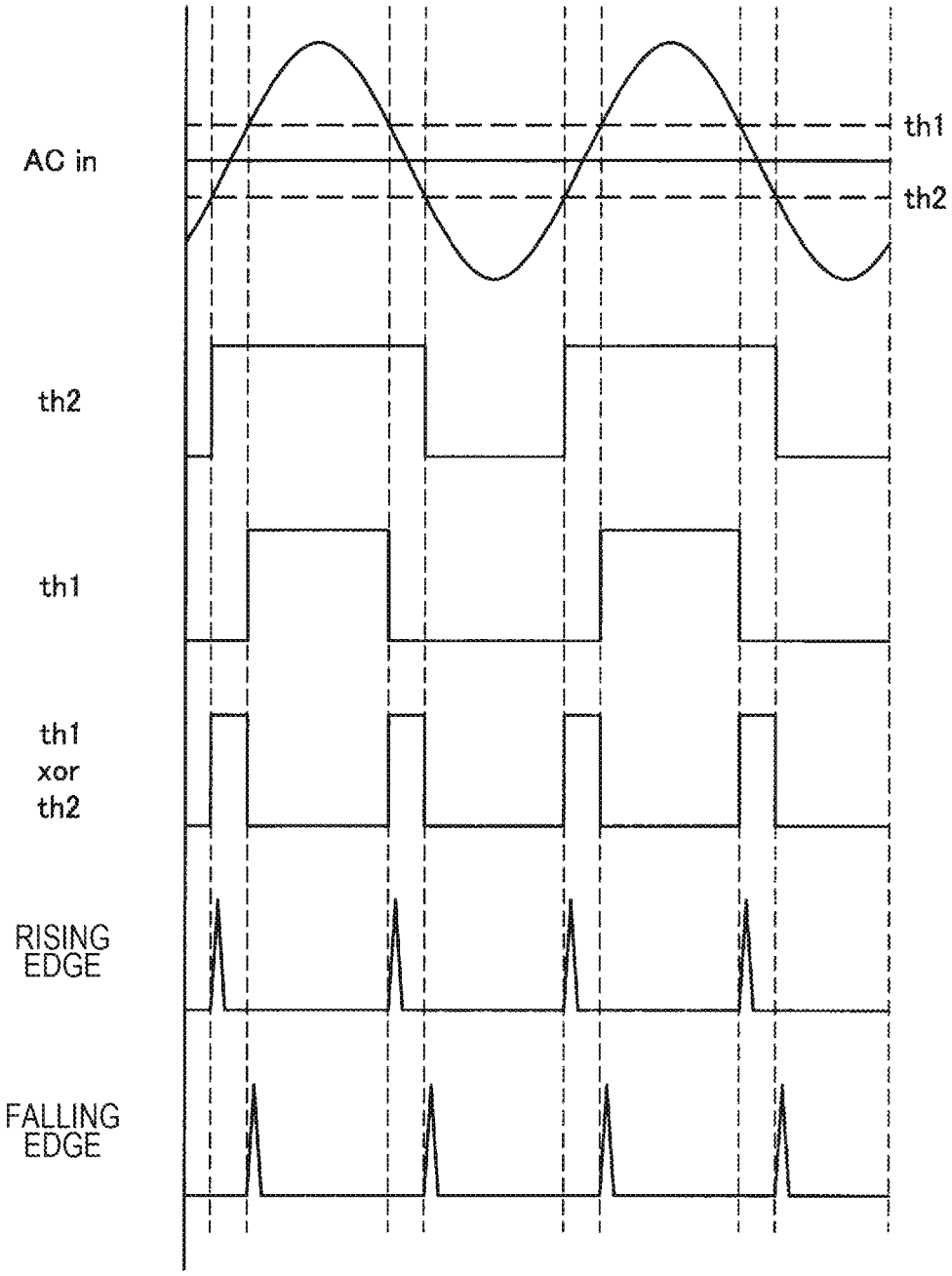
FIG. 13 is an explanatory view illustrating operation of trigger signal generation units 151 and 152.

The trigger signal generation units 151 and 152 input AC power from AC power supplies 1 and 2 and generate edge pulses. FIG. 13 is an explanatory view illustrating operation of the trigger signal generation units 151 and 152. The trigger signal generation units 151 and 152 take an exclusive OR for the period during which the voltage of the AC power supplies 1 and 2 is exceeding threshold values th1 and th2 (where th2<th1), i.e., generate a pulse in which the period of time during which the voltage of the AC power supplies 1 and 2 is between the threshold values th2 and th1 is high. Also, the trigger signal generation units 151 and 152 generate edge pulses at the time of the rise and fall of this pulse, respectively. The edge pulses generated by these trigger signal generation units 151 and 152 serve as trigger signals for switching the state of the RS flip-flop circuit RSFF2. The trigger signals output by the trigger signal generation units 151 and 152 are input to the NAND gates 141 and 142, respectively.

That is, as illustrated in FIG. 13, a rising edge is output at the timing at which the voltage of the AC power supplies 1 and 2 exceeds the threshold value th2 and at the timing at which the voltage of the AC power supplies 1 and 2 falls below the threshold value th1, and a falling edge is output at the timing at which the voltage of the AC power supplies 1 and 2 exceeds the threshold value th1 and at the timing at which the voltage of the AC power supplies 1 and 2 falls below the threshold value th2.

When the switch SW1 illustrated in FIG. 12 is connected to the contact a, the switching device 100 is such that the contact 1*b* of the mechanical relay RY1 is open, so the output of the AND gate 133 is low, and the outputs of the NAND gates 141 and 142 become high. As a result, the switching device 100 illustrated in FIG. 12 turns the SSR 101 on because the output on the a-side of the RS flip-flop circuit RSFF2 becomes high. Also, the switching device 100 illustrated in FIG. 12 turns the SSR 102 off because the output on the b-side of the RS flip-flop circuit RSFF2 becomes low. The switching device 100 illustrated in FIG. 12 outputs power from the power supply 1 by passing current through the mechanical relay RY1 and turning on the SSR 101, when the switch SW1 is connected to the contact a.

When the switch SW1 illustrated in FIG. 12 switches so as to move away from the contact a and connect to the contact b from this state, the RS flip-flop circuit RSFF1 gradually passes current through the mechanical relay RY2, and the mechanical relay RY2 gradually generates electromagnetic force by the current output from the RS flip-flop circuit RSFF1. When the electromagnetic force generated by the mechanical relay RY2 reaches a certain degree, the mechanical relay RY2 breaks the connection with the contact 1*b*.

On the other hand, the RS flip-flop circuit RSFF1 gradually stops the current from flowing through the mechanical relay RY1, so the mechanical relay RY1 gradually decreases the electromagnetic force. When the electromagnetic force generated by the mechanical relay RY1 starts to decrease, the mechanical relay RY1 breaks the connection with the contact 1*a*. When the electromagnetic force decreases further, the mechanical relay RY1 connects to the contact 1*b*.

Here, in the switching device 100 in FIG. 12, the mechanical relays RY1 and RY2 are simultaneously off, i.e., are both connected to the contacts 1*b*, so the output of the AND gate 133 at this timing becomes high. As a result, the switching device 100 illustrated in FIG. 12 turns the SSR 101 off because the output on the a-side of the RS flip-flop circuit RSFF2 becomes low. Then after the SSR 101 has been turned off, the switching device 100 illustrated in FIG. 12 turns the SSR 102 on because the output on the b-side of the RS flip-flop circuit RSFF2 becomes high.

With the switching device 100 illustrated in FIG. 12, the outputs of the trigger signal generation units 151 and 152 are input to the NAND gates 141 and 142, respectively. By inputting the outputs of the trigger signal generation units 151 and 152 to the NAND gates 141 and 142, respectively, the output of the RS flip-flop circuit RSFF2 is switched by the trigger signals that are output by the trigger signal generation units 151 and 152, while the mechanical relays RY1 and RY2 are off at the same time. As a result of the output of the RS flip-flop circuit RSFF2 switching, the SSR 101 switches from on to off, and the SSR 102 switches from off to on. Then, the gate of the RS flip-flop circuit RSFF1 switches so that the mechanical relay RY2 turns on.

The switching device 100 illustrated in FIG. 12 is able to both continue to stably output power by absorbing chattering in the mechanical relays RY1 and RY2, and suppress arcing in the mechanical relays RY1 and RY2, even when the connection of the switch SW1 switches between the contact a and the contact b.

Also, the switching device 100 illustrated in FIG. 12 transmits the output of the switch SW1 to the RS flip-flop circuit RSFF2 after confirming that the mechanical relays RY1 and RY2 are off at the same time, and is thus able to control the operation of the RS flip-flop circuit RSFF2 such that neither of the outputs of the RS flip-flop circuit RSFF2 will be high. That is, the switching device 100 illustrated in FIG. 12 is able to prevent power from being output from the two power supplies 1 and 2 simultaneously, by transmitting the output of the switch SW1 to the RS flip-flop circuit RSFF2 after confirming that the mechanical relays RY1 and RY2 are off at the same time.

Also, the switching device 100 illustrated in FIG. 12 is provided with the trigger signal generation units 151 and 152, and is able to switch the SSRs 101 and 102 that are zero cross control relays on and off with the voltage of the power supplies 1 and 2 near 0 V, by outputting the trigger signals at the timing at which the voltage of the power supplies 1 and 2 exceeds a predetermined threshold value t2 and at the timing at which the voltage of the power supplies 1 and 2 falls below a threshold value t1.

Figure 14:
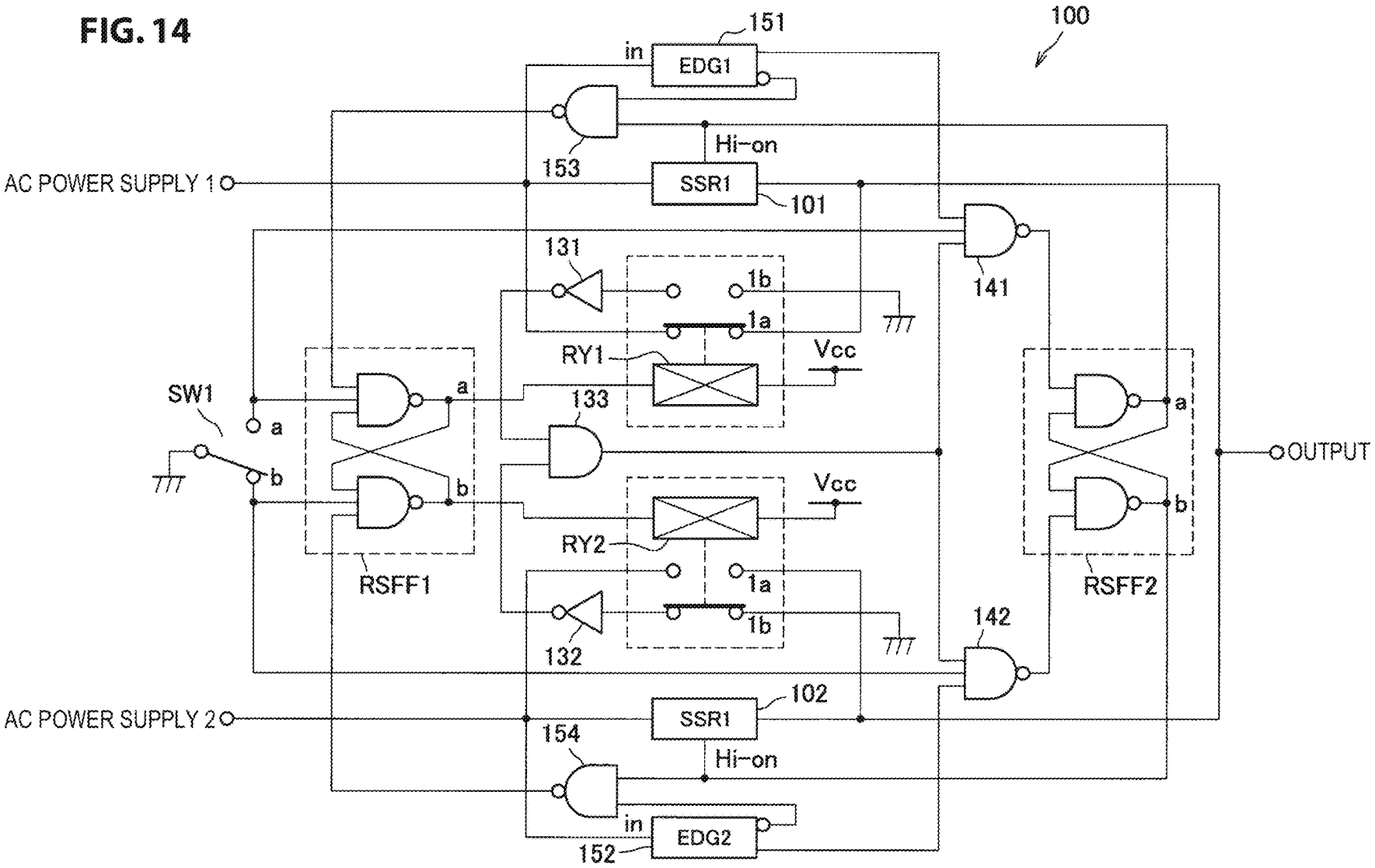
FIG. 14 is an explanatory view illustrating a configuration example of a switching device 100 according to an embodiment of the present disclosure.

FIG. 14 is an explanatory view illustrating a configuration example of a switching device 100 according to an embodiment of the present disclosure. The switching device 100 illustrated in FIG. 14 is a device that switches so as to output power from one of alternating-current (AC) power supplies 1 and 2.

The switching device 100 illustrated in FIG. 14 includes SSRs 101 and 102, mechanical relays RY1 and RY2, a switch SW1, RS flip-flop circuits RSFF1 and RSFF2, inverters 131 and 132, an AND gate 133, NAND gates 141, 142, 153, and 154, and trigger signal generation units 151 and 152. Note that the SSRs 101 and 102 in FIG. 12 are zero cross control relays.

The trigger signal generation units 151 and 152 illustrated in FIG. 14 output the rising edge and the falling edge illustrated in FIG. 13. The trigger signal generation units 151 and 152 output the rising edge to the NAND gates 141 and 142, and output the falling edge to the NAND gates 153 and 154. The NAND gates 153 and 154 input the falling edge output by the trigger signal generation units 151 and 152, respectively, and the output of the RS flip-flop circuit RSFF2, and supply outputs corresponding to these inputs to the RS flip-flop circuit RSFF1.

By having the trigger signal generation units 151 and 152 output the falling edge to the NAND gates 153 and 154, the switching device 100 illustrated in FIG. 14 is able to use the falling edge output by the trigger signal generation units 151 and 152 as a trigger to switch the RS flip-flop circuit RSFF1. By using the falling edge output by the trigger signal generation units 151 and 152 as a trigger to switch the RS flip-flop circuit RSFF1, the switching device 100 is able to lengthen the period of time during which the SSRs 101 and 102 are switched on and off compared to the configuration illustrated in FIG. 12.

Figure 15:
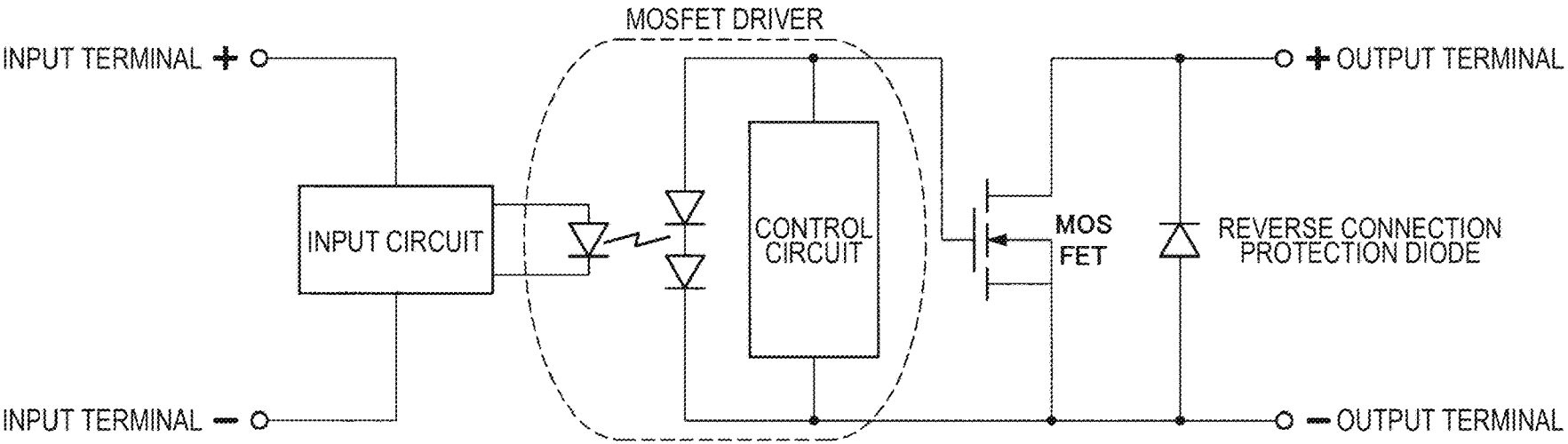
FIG. 15 is a configuration example of an SSR when the switching device 100 outputs power from a direct-current power supply.
Figure 16:
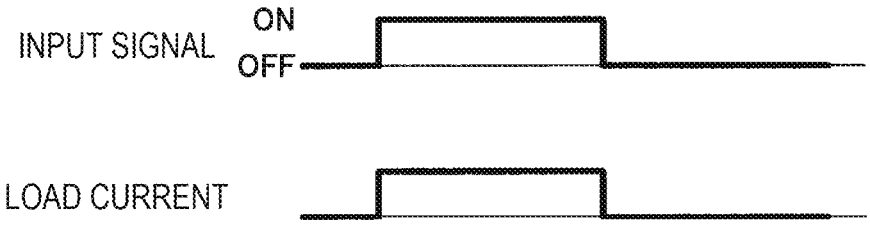
FIG. 16 is an explanatory view illustrating operation of the SSR illustrated in FIG. 15.

A configuration example of the SSRs 101 and 102 will now be described. FIG. 15 is a configuration example of an SSR when the switching device 100 outputs power from a direct-current power supply, and is a configuration example of an SSR using a MOSFET driver as the insulation method. Also, FIG. 16 is an explanatory view illustrating operation of the SSR illustrated in FIG. 15. The SSR illustrated in FIG. 15 outputs a load current only when an input signal is on, as illustrated in FIG. 16.

Figure 17:
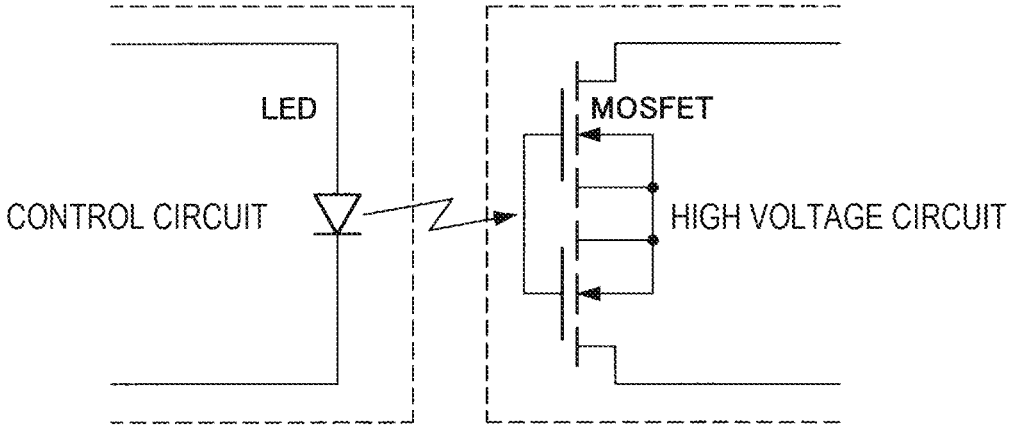
FIG. 17 is a configuration example of an SSR with no polarity.

FIG. 17 is a configuration example of an SSR with no polarity, and is a configuration example of an SSR that can be applied in a case where the switching device 100 outputs power from a direct-current power supply, as well as in a case where the switching device 100 outputs power from an alternating-current power supply.

Figure 18:
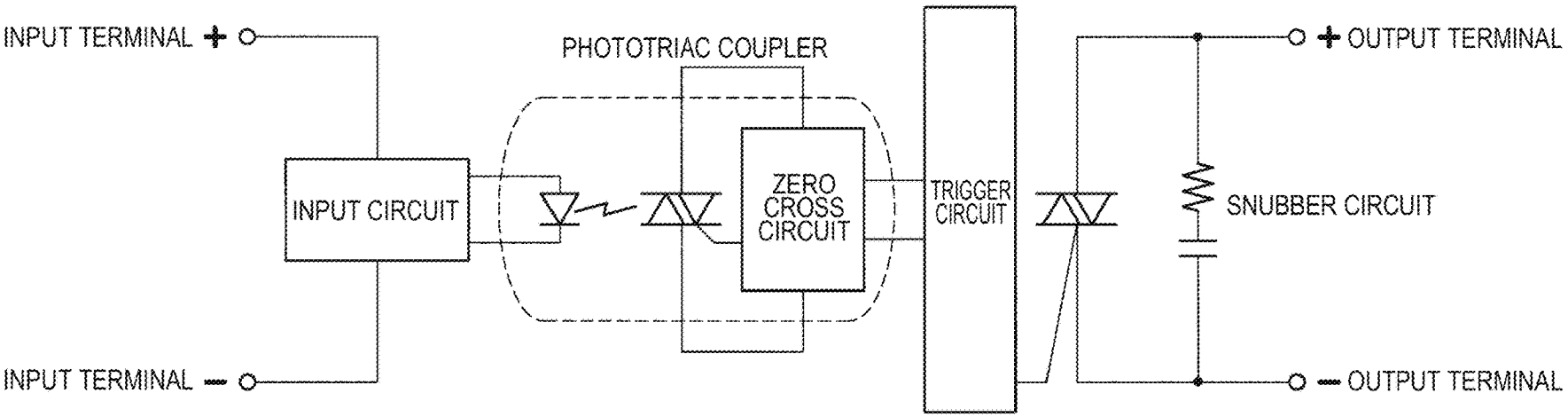
FIG. 18 is a configuration example of an SSR when the switching device 100 outputs power from a direct-current power supply.
Figure 19:
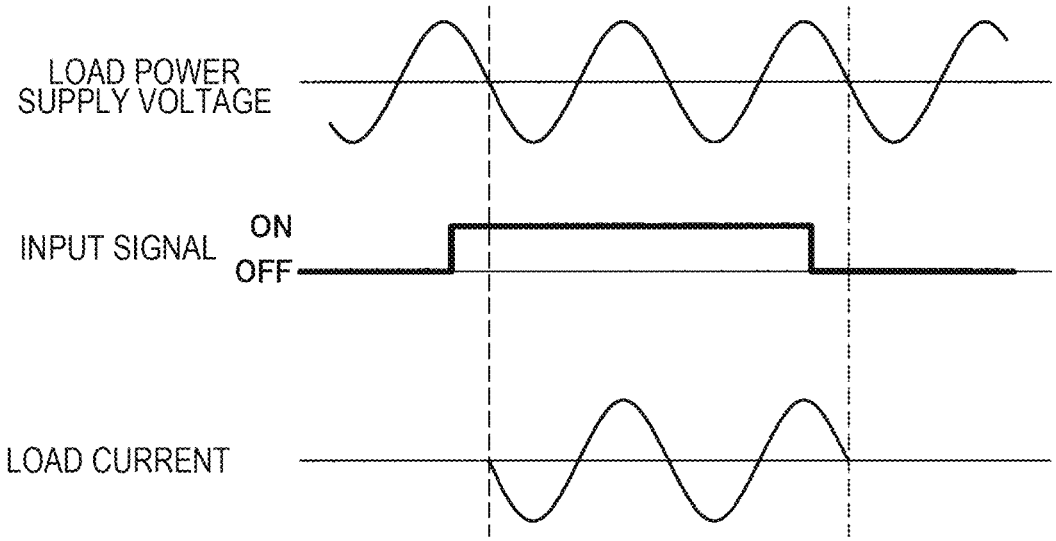
FIG. 19 is an explanatory view illustrating operation of an SSR using a phototriac as the insulation method, illustrated in FIG. 18.

FIG. 18 is a configuration example of an SSR when the switching device 100 outputs power from a direct-current power supply, and is a configuration example of an SSR using a phototriac as the insulation method. Also, FIG. 19 is an explanatory view explaining operation of the SSR using a phototriac as the insulation method, illustrated in FIG. 18. The SSR illustrated in FIG. 18 is provided with a zero cross circuit, and thus outputs a load current only when the input signal is on, as shown in FIG. 19, but starts and stops output of the load current at the point when the voltage output from the alternating-current power supply reaches 0 V.

Naturally, the configuration of the SSRs 101 and 102 is not limited to the configuration described above.

In the switching device 100 described up to this point, a case where automatic reset relays are used for the mechanical relays RY1 and RY2 has been described, but the present disclosure is not limited to this example. The switching device 100 may also use a latching relay to supply and interrupt power.

Figure 20:
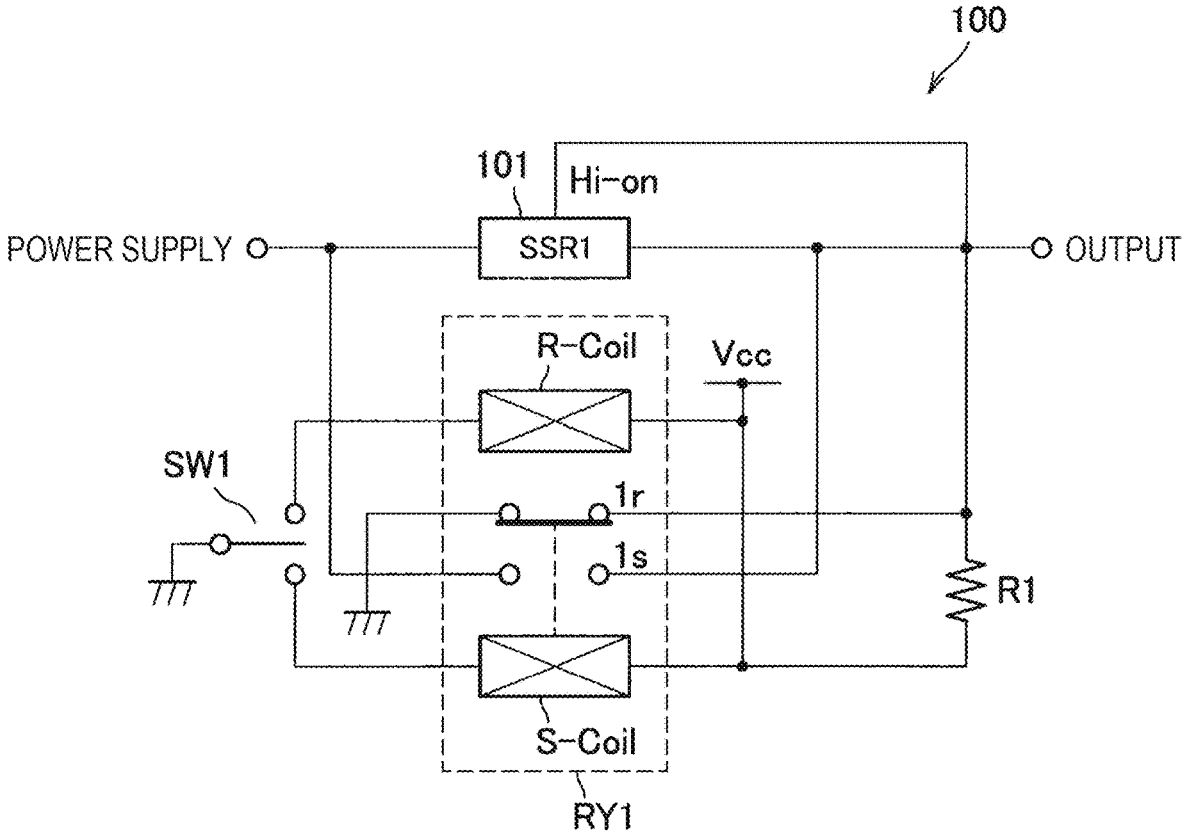
FIG. 20 is an explanatory view illustrating a configuration example of a switching device 100 according to an embodiment of the present disclosure.

FIG. 20 is an explanatory view illustrating a configuration example of a switching device 100 according to an embodiment of the present disclosure. The configuration example of the switching device 100 illustrated in FIG. 20 is an example of a case where a latching relay is used for the mechanical relay RY1.

The switching device 100 illustrated in FIG. 20 includes an SSR 101, a mechanical relay RY1, a switch SW1, and a resistor R1. The switch SW1 in the switching device 100 illustrated in FIG. 20 is a momentary switch. Current flows through a reset coil (R-coil) of the mechanical relay RY1 while the switch SW1 illustrated in FIG. 20 is connected to the contact a. When current flows through the reset coil (R-coil) of the mechanical relay RY1, the mechanical relay RY1 connects to a contact 1*r*. When the mechanical relay RY1 connects to the contact 1*r*, a ground potential is supplied to the SSR 101, so the SSR 101 turns off. Therefore, the switching device 100 illustrated in 20 interrupts power from the power supply while the switch SW1 is connected to the contact a.

On the other hand, current flows through a set coil (S-coil) of the mechanical relay RY1 while the switch SW1 illustrated in FIG. 20 is connected to the contact b. When current flows through the set coil (S-coil) of the mechanical relay RY1, the mechanical relay RY1 connects to a contact 1*s*. When the mechanical relay RY1 connects to the contact 1*s*, a predetermined potential $V_{CC}$ is supplied to the SSR 101, so the SSR 101 turns on. Also, when the mechanical relay RY1 connects to the contact 1*s*, power from the power supply can be output bypassing the SSR 101. Therefore, the switching device 100 illustrated in FIG. 20 outputs power from the power supply without interruption, while the switch SW1 is connected to the contact 1*b*.

With the switching device 100 described up to this point, at least five terminals, i.e., a power supply input, an output, a relay power supply, a ground, and an input of the switch SW1, were required. Hereinafter, a switching device that can be connected in the same way as a typical relay, by having the number of terminals be four, will be described.

Figure 21:
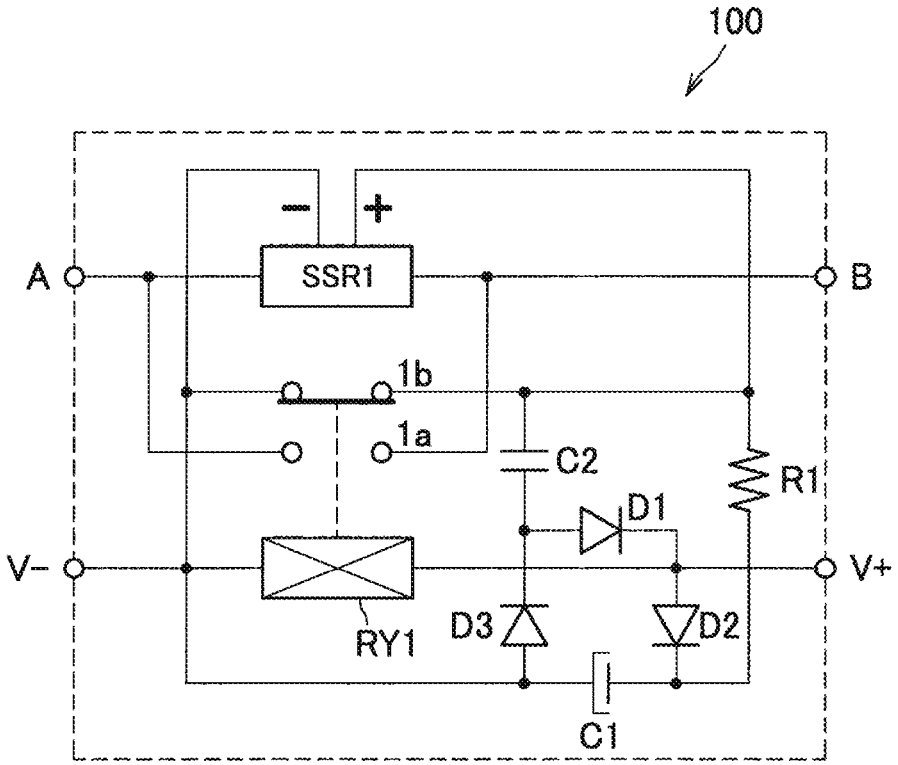
FIG. 21 is an explanatory view illustrating a configuration example of a switching device 100 according to an embodiment of the present disclosure.

FIG. 21 is an explanatory view illustrating a configuration example of a switching device 100 according to an embodiment of the present disclosure. The configuration example of the switching device 100 illustrated in FIG. 21 is an example of a case where connection can be made in the same way as with a typical relay, by having the number of terminals be four.

The switching device 100 illustrated in FIG. 21 includes an SSR 101, a mechanical relay RY1, diodes D1, D2, and D3, capacitors C1 and C2, and a resistor R1. The mechanical relay RY1 operates to switch contacts using electromagnetic force generated by current that flows from a terminal V+ to a terminal V−. The mechanical relay RY1 connects to the contact 1*b* in a case where current is not flowing from the terminal V+ to the terminal V−, and connects to the contact 1*a* using electromagnetic force in a case where current is flowing from the terminal V+ to the terminal V−. The SSR 101 is provided in a power supply path from a terminal A to a terminal B. In the embodiment, the SSR 101 is configured to turn on when high voltage is applied to a control terminal, and turn off when low voltage is applied to the control terminal.

Figure 22:
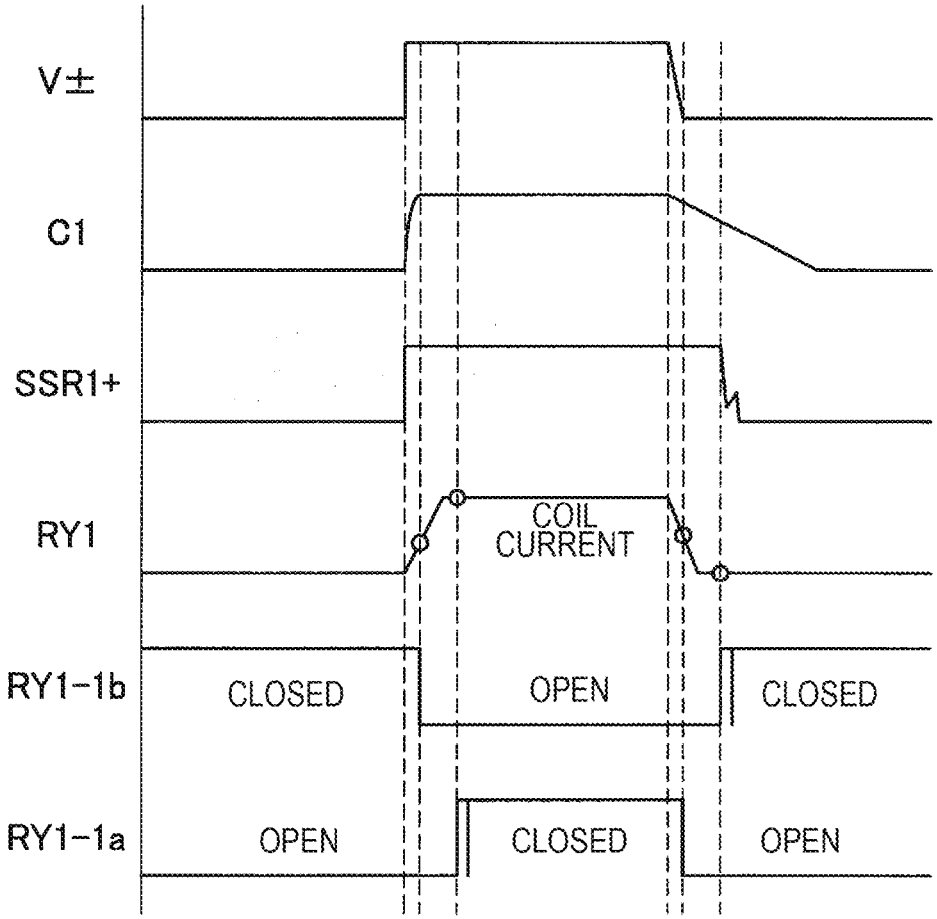
FIG. 22 is a timing chart illustrating operation of the switching device 100 illustrated in FIG. 21.

FIG. 22 is a timing chart illustrating operation of the switching device 100 illustrated in FIG. 21. As described above, in a case where current is not flowing from the terminal V+ to the terminal V−, current is not flowing through the mechanical relay RY1, so the mechanical relay RY1 is connected to the contact 1*b*. Therefore, the contact 1*b* of the mechanical relay RY1 is closed and the contact 1*a* is open.

Then, when voltage is applied to the terminal V+ and current flows from the terminal V+ to the terminal V−, the mechanical relay RY1 gradually generates electromagnetic force. When the electromagnetic force generated by the mechanical relay RY1 reaches a certain degree, the mechanical relay RY1 breaks the connection with the contact 1*b*. When the electromagnetic force increases further, the mechanical relay RY1 connects to the contact 1*a*, but chattering occurs when connecting to this contact 1*a*. Also, when voltage is applied to the terminal V+, this voltage is applied to the control terminal of the SSR 101, and the SSR 101 turns on. Then, when current flows from the terminal V+ to the terminal V−, an electrical charge is stored in the capacitor C1 through the diode D1.

And after that, when voltage stops being applied to the terminal V+ and current stops flowing from the terminal V+ to the terminal V−, the mechanical relay RY1 gradually decreases the electromagnetic force. When the electromagnetic force generated by the mechanical relay RY1 starts to decrease, the mechanical relay RY1 breaks the connection with the contact 1*a*. When the electromagnetic force decreases further, the mechanical relay RY1 connects to the contact 1*b*, but chattering occurs when connecting to this contact 1*b*.

At this time, it is desirable that the capacitor C1 be able to store enough power to turn the SSR 101 on until the mechanical relay RY1 connects to the contact 1*b*. Also at this time, the diode D2 is released from the reverse bias and conducts electricity, and the capacitor C2 operates through the coil of the mechanical relay RY1. In other words, the capacitor C2 absorbs the chattering that occurs when the mechanical relay RY1 connects to the contact 1*b*. Also, the capacitor C2 also forms a discharge circuit of the capacitor C1 through the diode D3, and absorbs surges in the mechanical relay RY1.

Therefore, the switching device 100 illustrated in FIG. 21 is able to suppress arcing and absorb surges, even when current stops flowing from the terminal V+ to the terminal V−, and the mechanical relay RY1 breaks the connection with the contact 1*a*. Also, the switching device 100 illustrated in FIG. 21 can be connected in the same way as a typical relay, by having the number of terminals be four, and can thus be used in place of an existing relay.

Figure 23:
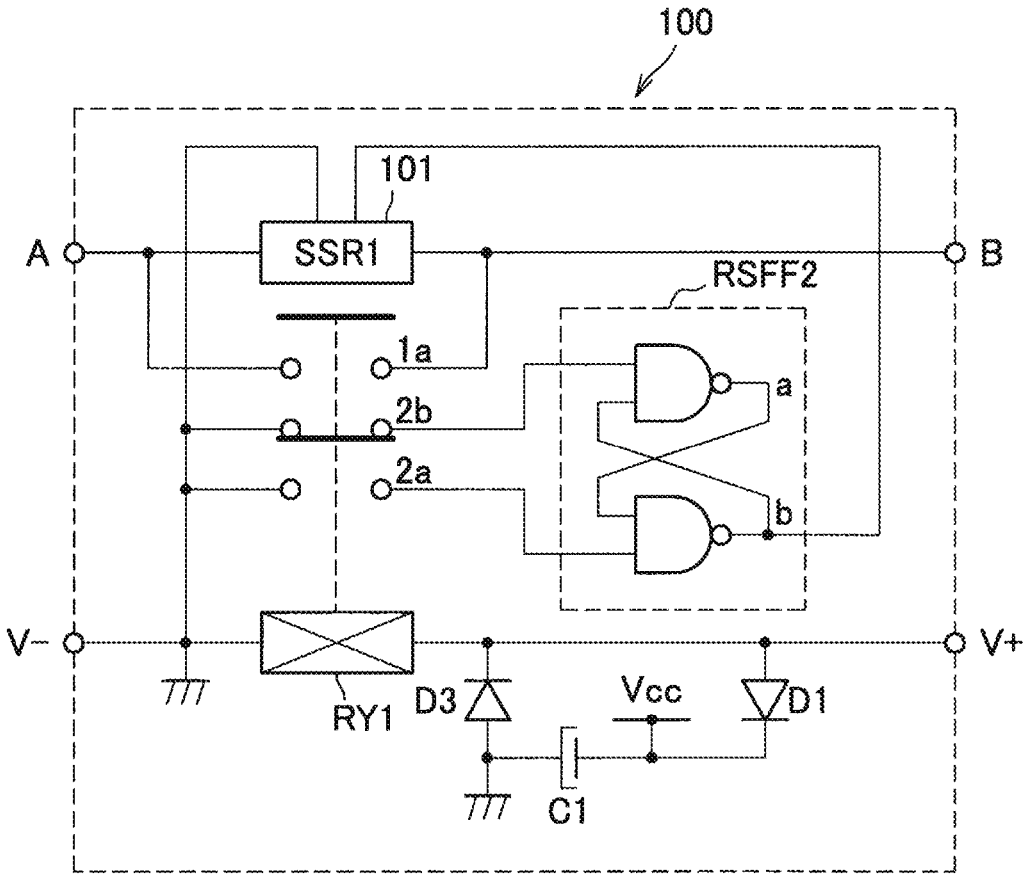
FIG. 23 is an explanatory view illustrating a configuration example of a switching device 100 according to an embodiment of the present disclosure.

FIG. 23 is an explanatory view illustrating a configuration example of a switching device 100 according to an embodiment of the present disclosure. The configuration example of the switching device 100 illustrated in FIG. 23 is an example of a case where connection can be made in the same way as with a typical relay, by having the number of terminals be four.

The switching device 100 illustrated in FIG. 23 includes an SSR 101, a mechanical relay RY1, diodes D1 and D3, a capacitor C1, and an RS flip-flop circuit RSFF2. The mechanical relay RY1 operates to switch contacts using electromagnetic force generated by current that flows from a terminal V+ to a terminal V−. The mechanical relay RY1 connects to the contact 1*b* in a case where current is not flowing from the terminal V+ to the terminal V−, and connects to the contacts 1*a* and 2*a* using electromagnetic force in a case where current is flowing from the terminal V+ to the terminal V−. The SSR 101 is provided in a power supply path from a terminal A to a terminal B. In the embodiment, the SSR 101 is configured to turn on when high voltage is applied to a control terminal, and turn off when low voltage is applied to the control terminal.

The RS flip-flop circuit RSFF2 is a circuit that controls the operation of the SSR 101, and is a circuit that acts as the capacitor C1 of the switching device 100 illustrated in FIG. 21.

In the switching device 100 illustrated in FIG. 23, in a case where current is not flowing from the terminal V+ to the terminal V−, current is not flowing through the mechanical relay RY1, so the mechanical relay RY1 is connected to the contact 1*b*.

Then, when voltage is applied to the terminal V+ and current flows from the terminal V+ to the terminal V−, the mechanical relay RY1 gradually generates electromagnetic force. When the electromagnetic force generated by the mechanical relay RY1 reaches a certain degree, the mechanical relay RY1 breaks the connection with the contact 1*b*. When the electromagnetic force increases further, the mechanical relay RY1 connects to the contacts 1*a* and 2*a*, but chattering occurs when connecting to these contacts 1*a* and 2*a*. Also, when voltage is applied to the terminal V+, this voltage is applied to the control terminal of the SSR 101 via the RS flip-flop circuit RSFF2, and the SSR 101 turns on. Then, when current flows from the terminal V+ to the terminal V−, an electrical charge is stored in the capacitor C1 through the diode D1.

And after that, when voltage stops being applied to the terminal V+ and current stops flowing from the terminal V+ to the terminal V−, the mechanical relay RY1 gradually decreases the electromagnetic force. When the electromagnetic force generated by the mechanical relay RY1 starts to decrease, the mechanical relay RY1 breaks the connection with the contacts 1*a* and 2*a*. When the electromagnetic force decreases further, the mechanical relay RY1 connects to the contact 1*b*, but chattering occurs when connecting to this contact 1*b*. At this time, the power stored in the capacitor C1 is able to keep the SSR 101 on through the RS flip-flop circuit RSFF2, via the $V_{CC}$.

Therefore, the switching device 100 illustrated in FIG. 23 is able to suppress arcing, even when current stops flowing from the terminal V+ to the terminal V−, and the mechanical relay RY1 breaks the connection with the contact 1*a*. Also, the switching device 100 illustrated in FIG. 23 can be connected in the same way as a typical relay, by having the number of terminals be four, and can thus be used in place of an existing relay.

The switching device 100 described up until this point uses a mechanical relay that uses a relay coil to interrupt power from the power supply. Hereinafter, a switching device that uses a manual switch to interrupt power from a power supply will be described.

Figure 24:
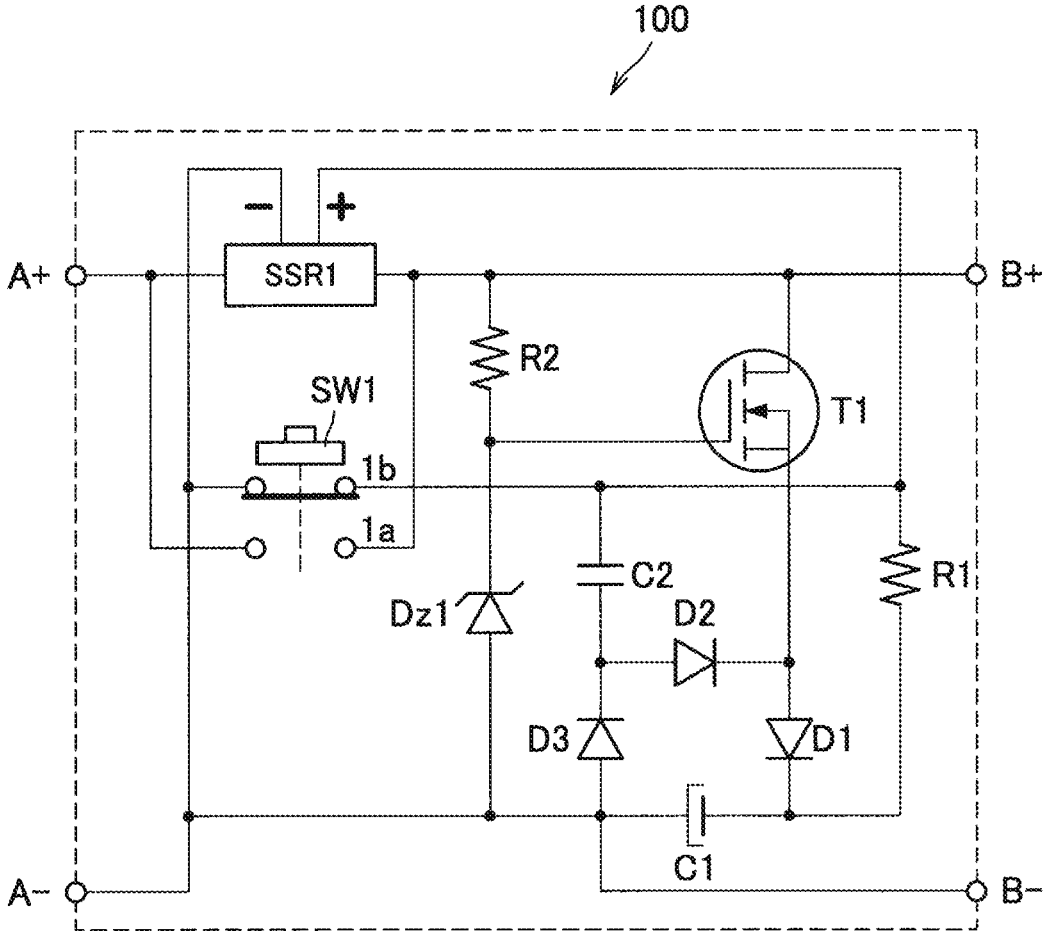
FIG. 24 is an explanatory view illustrating a configuration example of a switching device 100 according to an embodiment of the present disclosure.

FIG. 24 is an explanatory view illustrating a configuration example of a switching device 100 according to an embodiment of the present disclosure. The configuration example of the switching device 100 illustrated in FIG. 24 is an example of a case where connection can be made in the same way as with a typical relay, by having the number of terminals be four, and moreover, a manual switch is used to interrupt power from a power supply.

The switching device 100 illustrated in FIG. 24 includes an SSR 101, a switch SW1, diodes D1, D2, and D3, a Zener diode Dz1, capacitors C1 and C2, resistors R1 and R2, and a MOSFET T1. The switch SW1 is a push-type switch, for example, and is configured to connect to the contact 1*b* while not in a pushed-in state, and connect to the contact 1*a* while in a pushed-in state. The SSR 101 is provided in a power supply path from a terminal A to a terminal B. In the embodiment, the SSR 101 is configured to turn on when high voltage is applied to a control terminal, and turn off when low voltage is applied to the control terminal.

Figure 25:
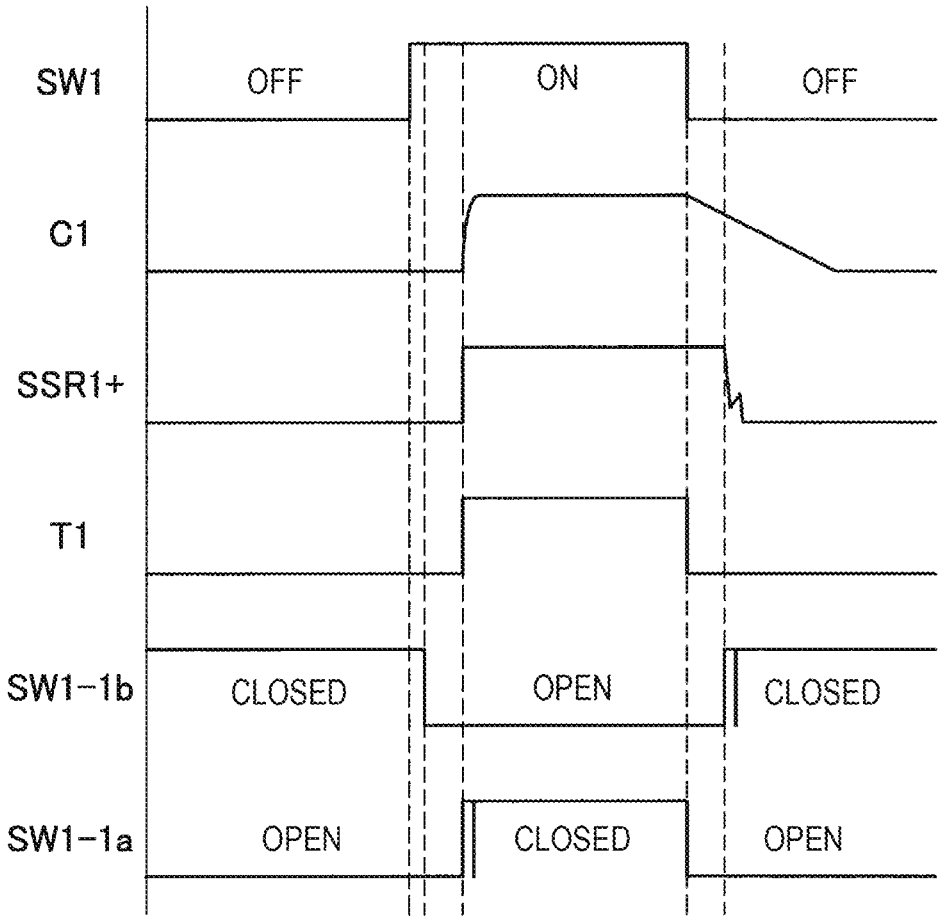
FIG. 25 is a timing chart illustrating operation of the switching device 100 illustrated in FIG. 24.

FIG. 25 is a timing chart illustrating operation of the switching device 100 illustrated in FIG. 24. As described above, in a state in which the switch SW1 is not pushed in, the switch SW1 is connected to the contact 1*b*. Therefore, the contact 1*b* of the switch SW1 is closed and the contact 1*a* is open.

Then, when the switch SW1 is pushed in, the switch SW1 breaks the connection with the contact 1*b*. Note that when the switch SW1 is pushed in and has broken the connection with the contact 1*b*, an electrical charge is not stored in the capacitor C1, so the SSR 101 is unable to be turned on. When the switch SW1 is pushed in further, the switch SW1 connects to the contact 1*a*, but chattering occurs when connecting to this contact 1*a*. When the switch SW1 connects to the contact 1*a*, the capacitor C1 charges via the MOSFET T1 and the diode D2. When the capacitor C1 is charged, the SSR 101 is able to turn on via the resistor R1 by the voltage in the capacitor C1.

And after that, when the switch SW1 breaks the connection with the contact 1*a*, the contact 1*a* is interrupted. When the switch SW1 breaks the connection with the contact 1*a*, the electrical charge stored in the capacitor C1 continues to keep the SSR 101 on via the resistor R1. Therefore, the inter-electrode voltage when the switch SW1 has broken the connection with the contact 1*a* is equal to or less than the condition (14 V) under which arcing will occur, because the SSR 101 is on.

And after that, when the switch SW1 connects to the contact 1*b*, the SSR 101 turns off, and further, the MOSFET T1 also turns off. When the switch SW1 connects to the contact 1*b*, the reverse bias voltage of the reverse diode of the MOSFET T1, and the diodes D2 and D3 disappears, and a filter circuit formed by the resistor R1 and the capacitor C2 is formed. The filter circuit formed by the resistor R1 and the capacitor C2 has the effect of reducing chattering when the switch SW1 connects to the contact 1*b*.

Therefore, with the switching device 100 illustrated in FIG. 24, arcing can be inhibited even if the switch SW1 breaks the connection with the contacts 1*a* and 2*a*. Also, the switching device 100 illustrated in FIG. 24 can be connected in the same way as a typical relay, by having the number of terminals be four, and can thus be used in place of an existing relay.

Figure 26:
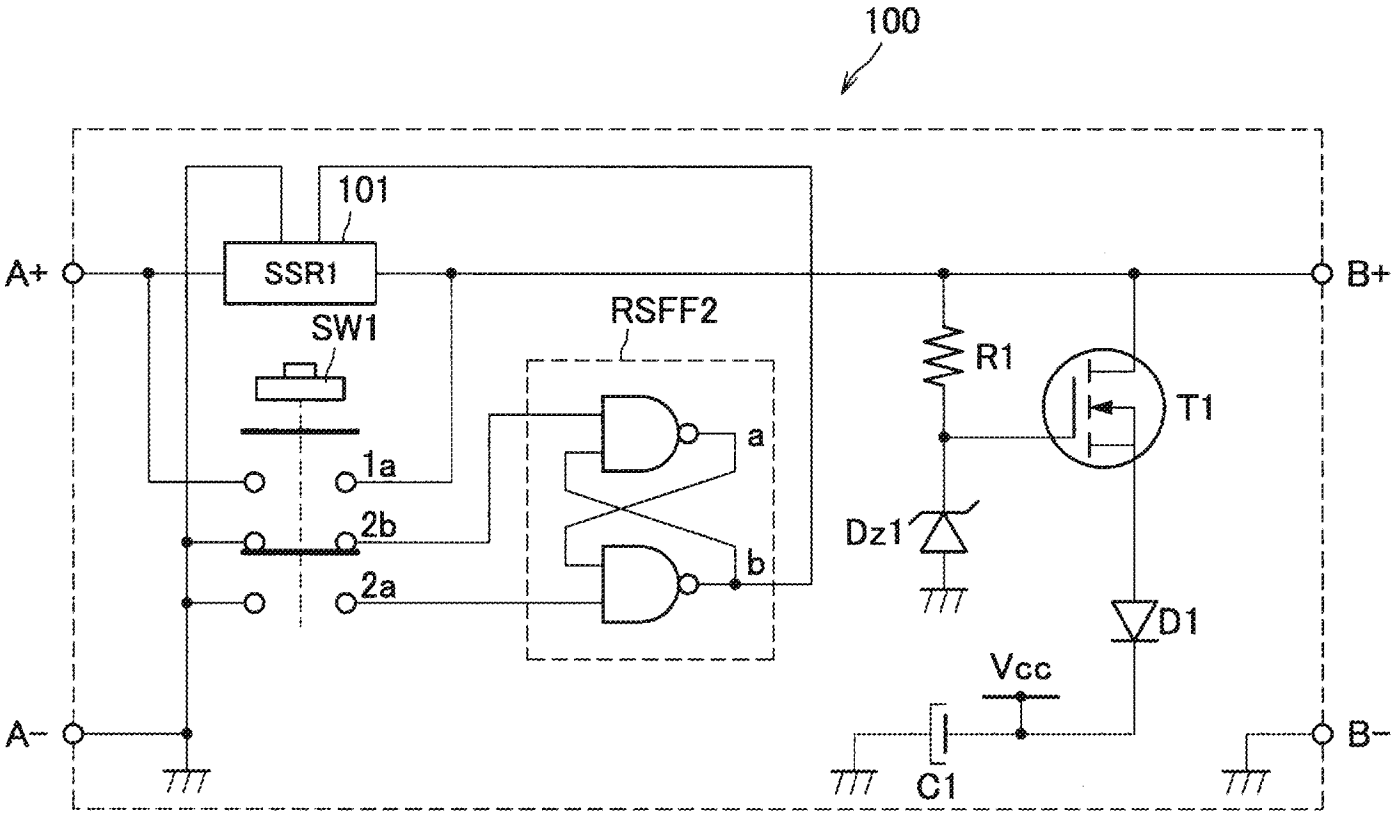
FIG. 26 is an explanatory view illustrating a configuration example of a switching device 100 according to an embodiment of the present disclosure.

FIG. 26 is an explanatory view illustrating a configuration example of a switching device 100 according to an embodiment of the present disclosure. The configuration example of the switching device 100 illustrated in FIG. 26 is an example of a case where connection can be made in the same way as with a typical relay, by having the number of terminals be four, and moreover, a manual switch is used to interrupt power from a power supply.

The switching device 100 illustrated in FIG. 26 includes an SSR 101, a switch SW1, a diode D1, a Zener diode Dz1, a capacitor C1, a resistor R1, a MOSFET T1, and an RS flip-flop circuit RSFF2. The switch SW1 is a push-type switch, for example, and is configured to connect to the contact 2*b* while not in a pushed-in state, and connect to the contacts 1*a* and 2*a* while in a pushed-in state. The SSR 101 is provided in a power supply path from a terminal A to a terminal B. In the embodiment, the SSR 101 is configured to turn on when high voltage is applied to a control terminal, and turn off when low voltage is applied to the control terminal.

The RS flip-flop circuit RSFF2 is a circuit that controls the operation of the SSR 101, and is a circuit that acts as the capacitor C1 of the switching device 100 illustrated in FIG. 24.

The switching device 100 illustrated in FIG. 26 is connected to the contact 2*b* while the switch SW1 is not in the pushed-in state.

Then, when the switch SW1 is pushed in, the switch SW1 breaks the connection with the contact 1*b*. When the switch SW1 is pushed in further, the switch SW1 connects to the contacts 1*a* and 2*a*, but chattering occurs when connecting to this contact 1*a*. When the switch SW1 connects to the contacts 1*a* and 2*a*, a high potential is applied to the control terminal of the SSR 101 through the RS flip-flop circuit RSFF2, and the SSR 101 turns on. Then, when current flows from a terminal A to a terminal B, an electrical charge is stored in the capacitor C1 through the MOSFET T1 and the diode D1.

And after that, when the switch SW1 breaks the connection with the contacts 1*a* and 2*a* and connects to the contact 2*b*, chattering occurs when connecting to this contact 2*b*. At this time, the power stored in the capacitor C1 is able to keep the SSR 101 on through the RS flip-flop circuit RSFF2, via the $V_{CC}$.

Therefore, with the switching device 100 illustrated in FIG. 26, arcing can be inhibited even if the switch SW1 breaks the connection with the contacts 1*a* and 2*a*. Also, the switching device 100 illustrated in FIG. 26 can be connected in the same way as a typical relay, by having the number of terminals be four, and can thus be used in place of an existing relay.

Figure 27:
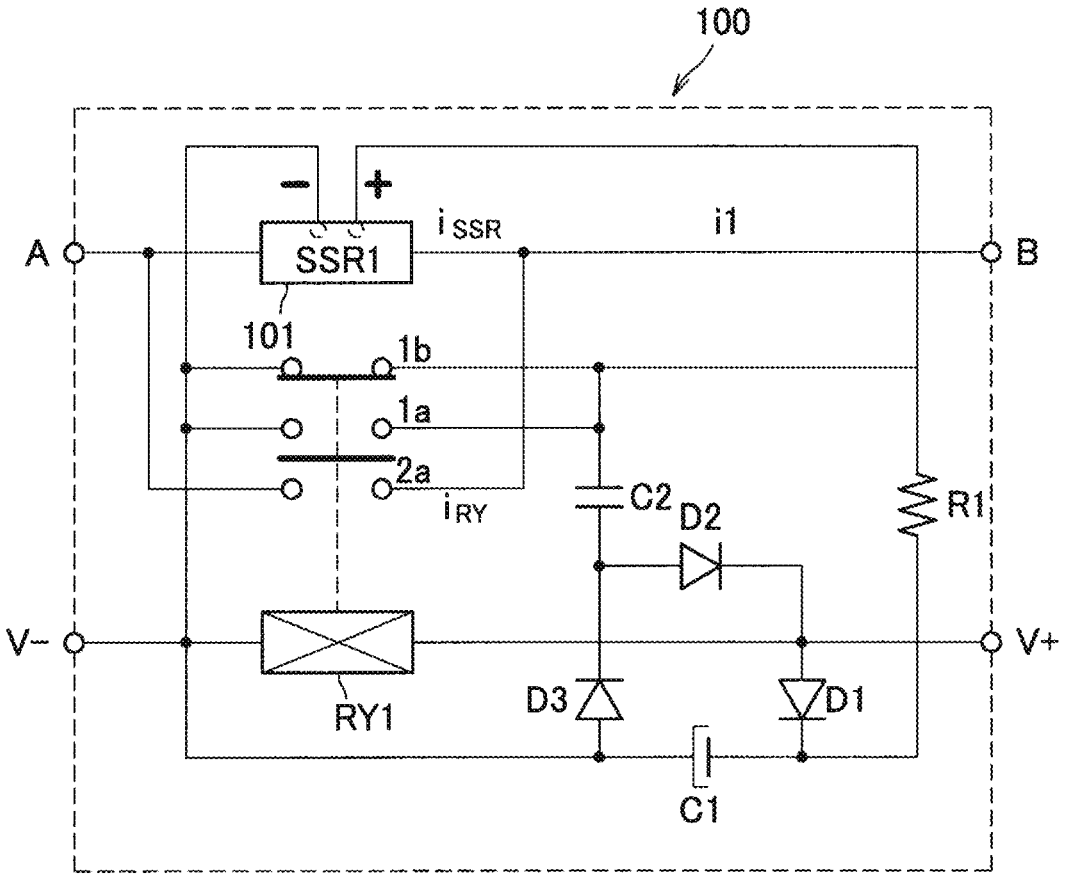
FIG. 27 is an explanatory view illustrating a configuration example of a switching device 100 according to an embodiment of the present disclosure.

FIG. 27 is an explanatory view illustrating a configuration example of a switching device 100 according to an embodiment of the present disclosure. The configuration example of the switching device 100 illustrated in FIG. 27 is an example of a case where connection can be made in the same way as with a typical relay, by having the number of terminals be four.

The switching device 100 illustrated in FIG. 27 includes an SSR 101, a mechanical relay RY1, diodes D1, D2, and D3, capacitors C1 and C2, and a resistor R1. The switching device 100 illustrated in FIG. 27 is designed to drive the SSR 101 only when the mechanical relay RY1 is switched, and then conduct electricity through the mechanical relay RY1. The mechanical relay RY1 operates to switch contacts using electromagnetic force generated by current that flows from a terminal V+ to a terminal V−. The mechanical relay RY1 connects to the contact 1*b* in a case where current is not flowing from the terminal V+ to the terminal V−, and connects to the contacts 1*a* and 2*a* using electromagnetic force in a case where current is flowing from the terminal V+ to the terminal V−. The SSR 101 is provided in a power supply path from a terminal A to a terminal B. In the embodiment, the SSR 101 is configured to turn on when high voltage is applied to a control terminal, and turn off when low voltage is applied to the control terminal.

Figure 28:
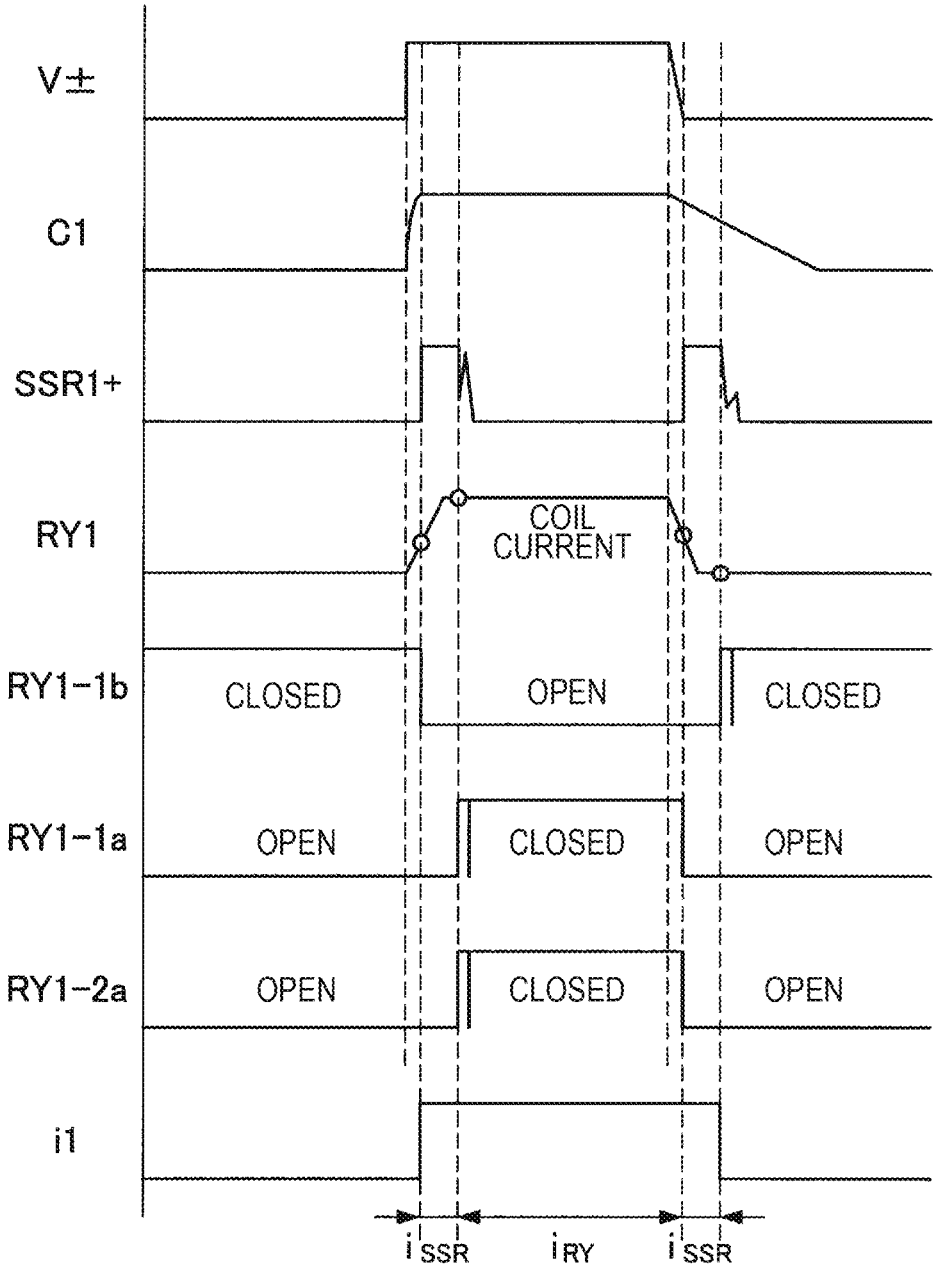
FIG. 28 is a timing chart illustrating operation of the switching device 100 illustrated in FIG. 27.

FIG. 28 is a timing chart illustrating operation of the switching device 100 illustrated in FIG. 27. In a case where current is not flowing from the terminal V+ to the terminal V−, current is not flowing through the mechanical relay RY1, so the mechanical relay RY1 is connected to the contact 1*b*. Therefore, the contact 1*b* of the mechanical relay RY1 is closed and the contacts 1*a* and 2*b* are open.

Then, when voltage is applied to the terminal V+ and current flows from the terminal V+ to the terminal V−, the mechanical relay RY1 gradually generates electromagnetic force. When the electromagnetic force generated by the mechanical relay RY1 reaches a certain degree, the mechanical relay RY1 breaks the connection with the contact 1*b*. When the mechanical relay RY1 breaks the connection with the contact 1*b*, a current it becomes a current $I_{SSR}$ that flows from the SSR 101.

When the electromagnetic force increases further, the mechanical relay RY1 connects to the contacts 1*a* and 2*a*, but chattering occurs when connecting to these contacts 1*a* and 2*a*. Also, when voltage is applied to the terminal V+, this voltage is applied to the control terminal of the SSR 101, and the SSR 101 turns on. Then, when current flows from the terminal V+ to the terminal V−, an electrical charge is stored in the capacitor C1 through the diode D1. Note that when the mechanical relay RY1 connects to the contacts 1*a* and 2*a*, the current it becomes a current $I_{RY}$ that flows through the contact 2*a* of the mechanical relay RY1.

And after that, when voltage stops being applied to the terminal V+ and current stops flowing from the terminal V+ to the terminal V−, the mechanical relay RY1 gradually decreases the electromagnetic force. When the electromagnetic force generated by the mechanical relay RY1 starts to decrease, the mechanical relay RY1 breaks the connection with the contacts 1*a* and 2*a*. When the mechanical relay RY1 breaks the connection with the contacts 1*a* and 2*a*, the current it becomes the current $I_{SSR}$ that flows from the SSR 101. When the electromagnetic force decreases further, the mechanical relay RY1 connects to the contact 1*b*, but chattering occurs when connecting to this contact 1*b*.

At this time, it is desirable that the capacitor C1 be able to store enough power to turn the SSR 101 on until the mechanical relay RY1 connects to the contact 1*b*. Also at this time, the diode D2 is released from the reverse bias and conducts electricity, and the capacitor C2 operates through the coil of the mechanical relay RY1. In other words, the capacitor C2 absorbs the chattering that occurs when the mechanical relay RY1 connects to the contact 1*b*. Also, the capacitor C2 also forms a discharge circuit of the capacitor C1 through the diode D3, and absorbs surges in the mechanical relay RY1.

Therefore, the switching device 100 illustrated in FIG. 27 is able to suppress arcing and absorb surges, even when current stops flowing from the terminal V+ to the terminal V−, and the mechanical relay RY1 breaks the connection with the contacts 1*a* and 2*a*. Also, the switching device 100 illustrated in FIG. 27 can be connected in the same way as a typical relay, by having the number of terminals be four, and can thus be used in place of an existing relay.

Also, the switching device 100 illustrated in FIG. 27 conducts electricity by only contact between the mechanical relay RY1 and the contact 2*a*, after the mechanical relay RY1 is driven and the contact switches such that the mechanical relay RY1 connects to the contacts 1*a* and 2*a*. At this time, even if the contact 2*a* of the mechanical relay RY1 has deteriorated due to an oxide film or the like, the mechanical relay RY1 displays a self-cleaning effect by a temporary spark that breaks down that film being generated at the contact 2*a*.

Figure 29:
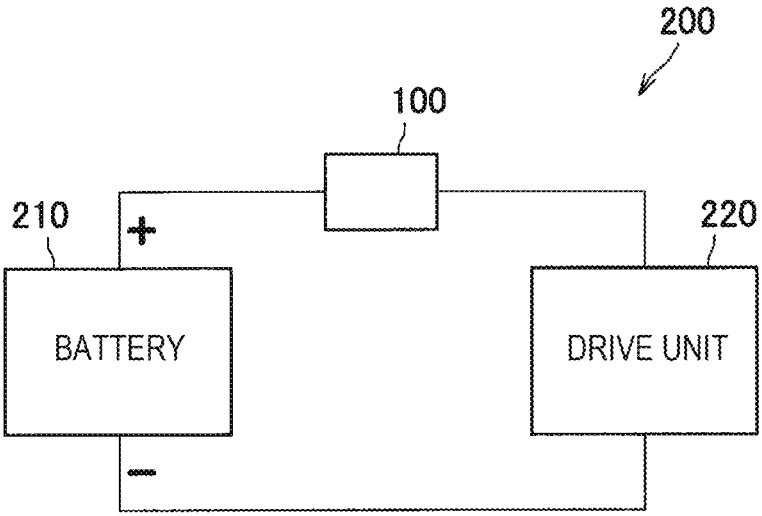
FIG. 29 is an explanatory view illustrating a functional configuration example of a mobile object 200 provided with the switching device 100.

FIG. 29 is an explanatory view illustrating a functional configuration example of a mobile object 200 provided with the switching device 100. The mobile object 200 may be, for example, a mobile object that uses gasoline as the power source, such as a gasoline-powered vehicle, or a mobile object that mainly uses a chargeable/dischargeable battery as the power source, such as an electric vehicle, a hybrid vehicle, or an electric motorbike. FIG. 27 illustrates an example of a case in which a battery 210, and a drive unit 220 driven by power supplied from the battery, are provided in the mobile object 200. The drive unit 220 can include equipment provided in a vehicle, such as wipers, power windows, lights, a car navigation system, and an air conditioner, as well as a device that drives the mobile object 200 such as a motor.

Also, in the mobile object 200 illustrated in FIG. 29, the switching device 100 is provided midway in the path along which direct-current power is supplied from the battery 210 to the drive unit 220. The mobile object 200 illustrated in FIG. 29 is able to suppress arc discharge at times such as when temporarily attaching and detaching the battery 210, for example, by providing a current limiting circuit 30 in the path along which direct-current power is supplied from the battery 210 to the drive unit 220.

Note that FIG. 29 illustrates an example in which the mobile object 200 is provided with only one switching device 100, but the present disclosure is not limited to this example. That is, a plurality of the switching devices 100 may be provided midway in the path along which direct-current power is supplied. Also, the switching device 100 may be provided not only midway in the path along which direct-current power is supplied from the battery 210 to the drive unit 220, but in another location, for example, midway along a path when charging the battery 210 with direct-current power. The mobile object 200 is able to safely charge the battery 210 with direct-current power by providing the current limiting circuit 30 midway along a path when charging the battery 210 with direct-current power.

Figure 30:
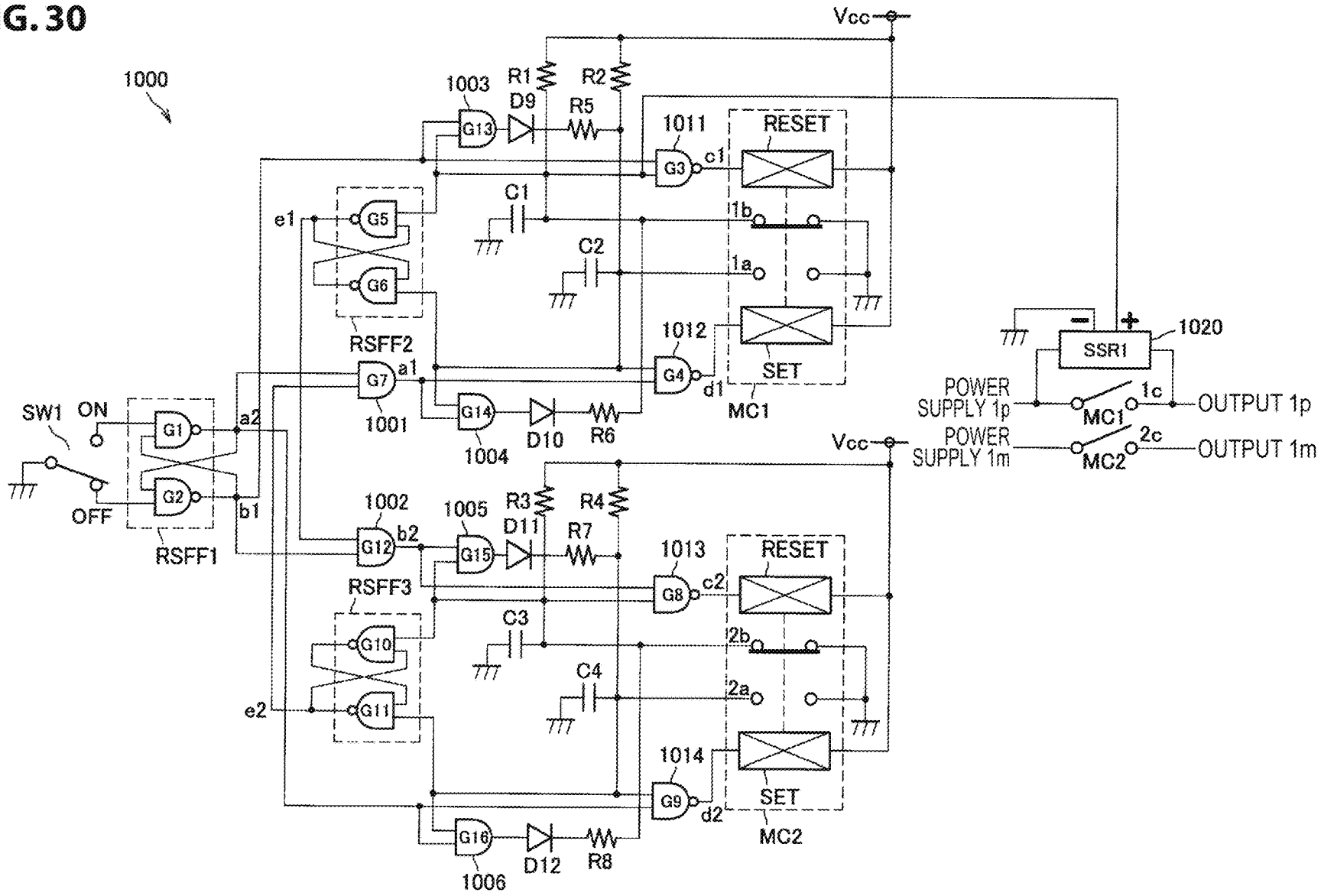
FIG. 30 is an explanatory view illustrating a configuration example of a switching device 1000 according to an embodiment of the present disclosure.

FIG. 30 is an explanatory view illustrating a configuration example of a switching device 1000 according to an embodiment of the present disclosure. The switching device 1000 illustrated in FIG. 30 is a double cutting composite-type relay, and is designed to suppress arc discharge and current interruption due to chattering in a mechanical relay, by combining an SSR 1020 with one of two self-holding mechanical relays MC1 and MC2. The switching device 1000 illustrated in FIG. 30 is configured to be able to suppress arcing and reliably cut off a power supply, when cutting off a two-wire power supply, using the single SSR 1020.

The switching device 1000 illustrated in FIG. 30 includes the self-holding mechanical relays MC1 and MC2, a switch SW1, RS flip-flop circuits RSFF1, RSFF2, and RSFF3, AND gates 1001, 1002, 1003, 1004, 1005, and 1006, NAND gates 1011, 1012, 1013, and 1014, the SSR 1020, diodes D9 to D12, capacitors C1 to C4, and resistors R1 to R8. The RS flip-flop circuits RSFF1, RSFF2, and RSFF3, the AND gates 1001 to 1006, and the NAND gates 1011, 1012, 1013, and 1014 function as one example of a timing adjustment circuit of the present disclosure.

Figure 31:
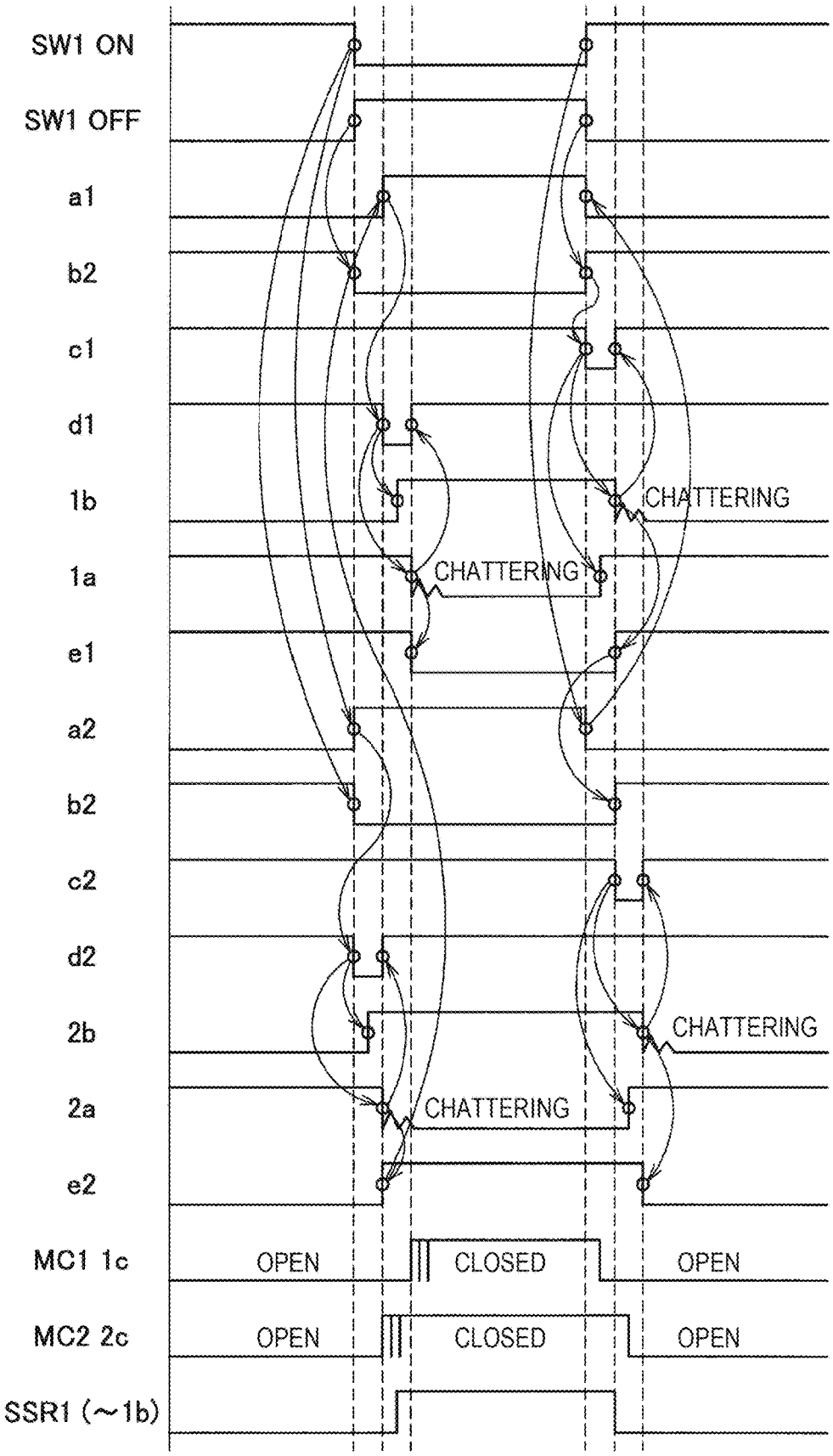
FIG. 31 is a timing chart illustrating operation of the switching device 1000 illustrated in FIG. 30.

Hereinafter, the operation of the switching device 1000 illustrated in FIG. 30 will be described. FIG. 31 is a timing chart illustrating operation of the switching device 1000 illustrated in FIG. 30.

A state in which power is not being output from two power supplies 1*p* and 1*m* is the initial state. In the initial state, the switch SW1 is off and the self-holding mechanical relay MC1 is in a reset state. In the initial state, the contact 1*b* of the self-holding mechanical relay MC1 is short-circuited so the potential is low (L). In the initial state, the self-holding mechanical relay MC2 is also in the reset state, and the contact 2*b* of the self-holding mechanical relay MC2 is short-circuited, so the potential is low (L).

When the switch SW1 switches to on from the initial state, an output a2 of the RS flip-flop circuit RSFF1 becomes high (H). When the output a2 of the RS flip-flop circuit RSFF1 becomes H, an output d2 of the NAND gate 1014 becomes L, and a set coil of the self-holding mechanical relay MC2 is actuated.

When the set coil of the self-holding mechanical relay MC2 is actuated, the contact 2*b* starts to separate and switches from L to H. At this time, charging to the capacitor C3 through the resistor R4 starts, but the output a2 of the RS flip-flop circuit RSFF1 and the state of the contact 2*a* of the self-holding mechanical relay MC2 are both H, so the output of the AND gate 1006 becomes H. When the output of the AND gate 1006 becomes H, the resistor R8 is added through the diode D12, and a parallel circuit is formed with the resistor R3. Therefore, a time constant that is the product of the resistor R3 and the capacitor C3 becomes smaller. As a result of the time constant that is the product of the resistor R3 and the capacitor C3 becoming smaller, the voltage rise in the contact 2*b* of the self-holding mechanical relay MC2 becomes faster.

Then, the contact 2*a* of the self-holding mechanical relay MC2 becomes L, but chattering occurs when the contact 2*a* becomes L. However, a change in voltage due to this chattering in the contact 2*a* is suppressed by a charge/discharge circuit formed by the capacitor C4 and the resistor R4. Then, the output d2 of the NAND gate 1014 becomes H, the set coil of the self-holding mechanical relay MC2 stops being driven, and an output e2 of the RS flip-flop circuit RSFF3 switches from L to H.

When the output e2 of the RS flip-flop circuit RSFF3 becomes H, the output a2 of the RS flip-flop circuit RSFF1 also becomes H, so the output a1 of the AND gate 1001 becomes H and the contact 1*a* of the self-holding mechanical relay MC1 becomes H, and consequently, the set coil of the self-holding mechanical relay MC1 is actuated.

When the set coil of the self-holding mechanical relay MC1 is actuated, the contact 1*b* of the self-holding mechanical relay MC1 starts to separate and becomes H, and charging from the resistor R1 to the capacitor C1 starts. However, because the output a1 of the AND gate 1001 and the state of the contact 1*a* of the self-holding mechanical relay MC1 are both H, the output of the AND gate 1004 becomes H. When the output of the AND gate 1004 becomes H, the resistor R6 is added through the diode D10, and a parallel circuit is formed with the resistor R1. Therefore, the time constant that is the product of the resistor R1 and the capacitor C1 becomes smaller. As a result of the time constant that is the product of the resistor R1 and the capacitor C1 becoming smaller, the voltage rise in the contact 1*b* of the self-holding mechanical relay MC1 becomes faster.

Then, the contact 1*a* of the self-holding mechanical relay MC1 becomes L, chattering occurs when the contact 1*a* becomes L, and a change in voltage due to this chattering is suppressed by a charge/discharge circuit formed by the capacitor C2 and the resistor R2. Then, the output d1 of the NAND gate 1012 becomes H, the set coil of the self-holding mechanical relay MC1 stops being driven, and the contact 1*a* of the self-holding mechanical relay MC1 becomes L, so the output e1 of the RS flip-flop circuit RSFF2 switches from H to L.

When the output e1 of the RS flip-flop circuit RSFF2 switches from H to L, the output b1 of the RS flip-flop circuit RSFF1 remains L, and the diode D9 that is connected via the AND gate 1003 turns off. When the diode D9 turns off, the resistor R5 does not function, and chattering of the self-holding mechanical relay MC1 is suppressed by the time constant that is based on the product of the capacitor C1 and the resistor R1. This completes the series of the on-sequence.

When the switch SW1 switches from on to off, the output b1 of the RS flip-flop circuit RSFF1 becomes H. Because the contact 1*b* of the self-holding mechanical relay MC1 is H, the output c1 of the AND gate 1011 becomes L, and the reset coil of the self-holding mechanical relay MC1 is actuated. When the reset coil of the self-holding mechanical relay MC1 is actuated, the contact 1*a* starts to separate and becomes L. Then, when the contact 1*b* short-circuits and becomes L, the output c1 of the NAND gate 1011 becomes H. When the output c1 of the NAND gate 1011 becomes H, the reset coil of the self-holding mechanical relay MC1 stops being driven, and the output e1 of the RS flip-flop circuit RSFF2 switches from L to H.

At the point in time at which the output e1 of the RS flip-flop circuit RSFF2 becomes H, the output b1 of the RS flip-flop circuit RSFF1 is already H, so the output b2 of the AND gate 1002 becomes H. Because the contact 2*b* of the self-holding mechanical relay MC2 is already H at the point at which the output b2 of the AND gate 1002 becomes H, the output c2 of the AND gate 1013 becomes L, and the reset coil of the self-holding mechanical relay MC2 is actuated.

When the reset coil of the self-holding mechanical relay MC2 is actuated, the contact 2*a* of the self-holding mechanical relay MC2 starts to separate and becomes H, and then the contact 2*b* becomes L, so the output c2 of the NAND gate 1013 becomes H, the reset coil of the self-holding mechanical relay MC2 stops being driven, and the output e2 of the RS flip-flop circuit RSFF3 switches from L to H, thus completing the series of the off-sequence. Here, the chattering suppression circuit functions appropriately by the time constant switching similar to the case of the on-sequence described above.

In each of the sequences described above, the voltage of the contact 1*b* of the self-holding mechanical relay MC1 is transmitted to the SSR 1020. In the on-sequence, the self-holding mechanical relay MC2 is on, the SSR 1020 is on, and the self-holding mechanical relay MC1 is on. In the off-sequence, the self-holding mechanical relay MC1 is off, the SSR 1020 is off, and the self-holding mechanical relay MC2 is off.

Therefore, the contact 2*c* of the self-holding mechanical relay MC2 is short-circuited while the contact 1*c* of the self-holding mechanical relay MC1 is disconnected, so no current flows. The contact 1*c* of the self-holding mechanical relay MC1 is short-circuited while the SSR 1020 is short-circuited, so the circuit current will not be affected even if there is chattering. During the off-sequence, the contact 1*c* of the self-holding mechanical relay MC1 is disconnected when the SSR 1020 is on, so the voltage between contacts is low, and arcing will not occur at the time of disconnection. Also, the SSR 1020 is turned off and then the 2*c* contact of the self-holding mechanical relay MC2 is disconnected, so no voltage is generated at the contact 2*c*, and thus arcing will not occur, when the self-holding mechanical relay MC2 is interrupted either.

The switching device 1000 illustrated in FIG. 30 is able to reliably disconnect the power supply while keeping costs down, by using only one SSR to suppress arcing and reliably disconnect the power supply, when disconnecting a two-wire power supply.

Figure 32:
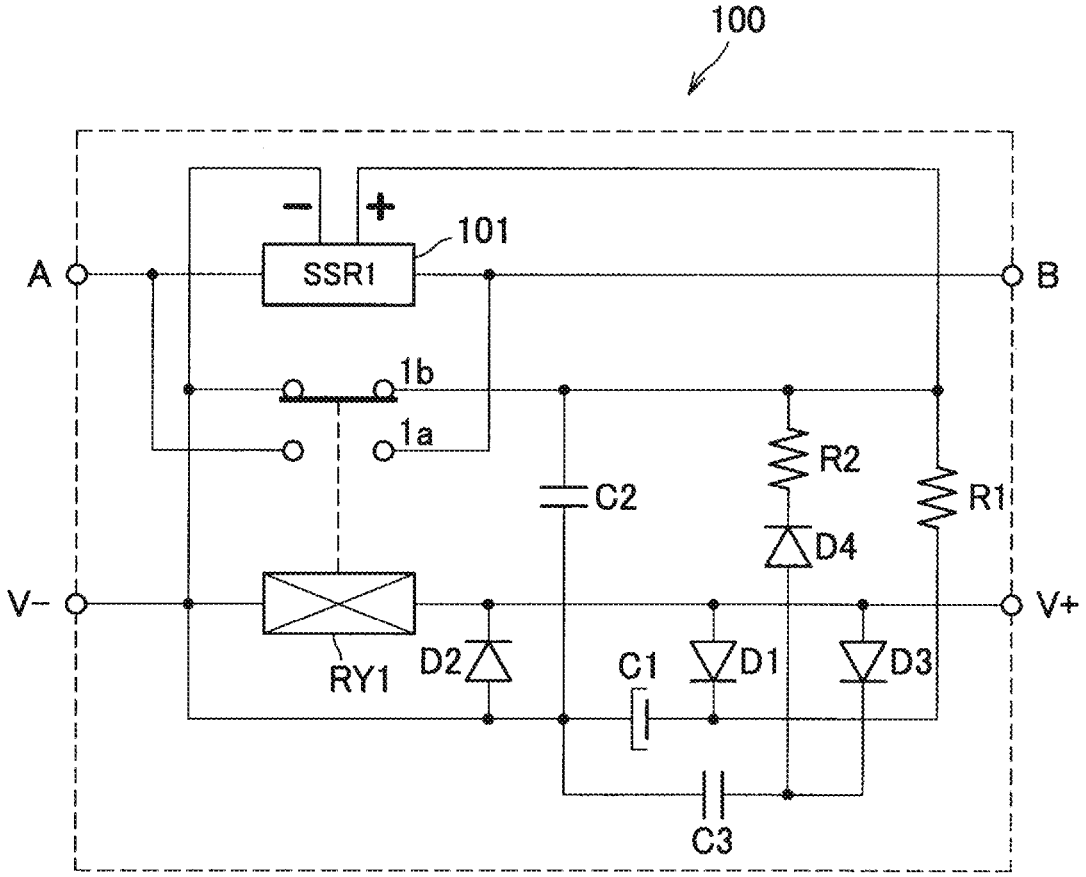
FIG. 32 is an explanatory view illustrating a configuration example of a switching device 100 according to an embodiment of the present disclosure.

FIG. 32 is an explanatory view illustrating a configuration example of a switching device 100 according to an embodiment of the present disclosure. The configuration example of the switching device 100 illustrated in FIG. 32 is a modification of the configuration of the switching device 100 illustrated in FIG. 21. Note that the switching device 100 illustrated in FIG. 32 operates in a manner similar to the manner shown in the timing chart illustrated in FIG. 22.

The switching device 100 illustrated in FIG. 32 includes an SSR 101, a mechanical relay RY1, diodes D1, D2, D3, and D4, capacitors C1, C2, and C3, and resistors R1 and R2. The diode D2 illustrated in FIG. 32 is provided to absorb surges in the mechanical relay RY1. The switching device 100 illustrated in FIG. 32 is able to shorten the time constant of an RC circuit provided in the SSR 101, by the resistor R2 being added via the diode D4, in addition to the capacitor C2 and the resistor R1, when power stops being supplied to the mechanical relay RY1. The diode D4 and the capacitor C3 form a circuit that stores power when power is no longer being supplied to the mechanical relay RY1.

Therefore, the switching device 100 illustrated in FIG. 32 is able to suppress arcing and absorb surges, even when current stops flowing from the terminal V+ to the terminal V−, and the mechanical relay RY1 breaks the connection with the contact 1*a*. Also, the switching device 100 illustrated in FIG. 32 can be connected in the same way as a typical relay, by having the number of terminals be four, and can thus be used in place of an existing relay.

Figure 33:
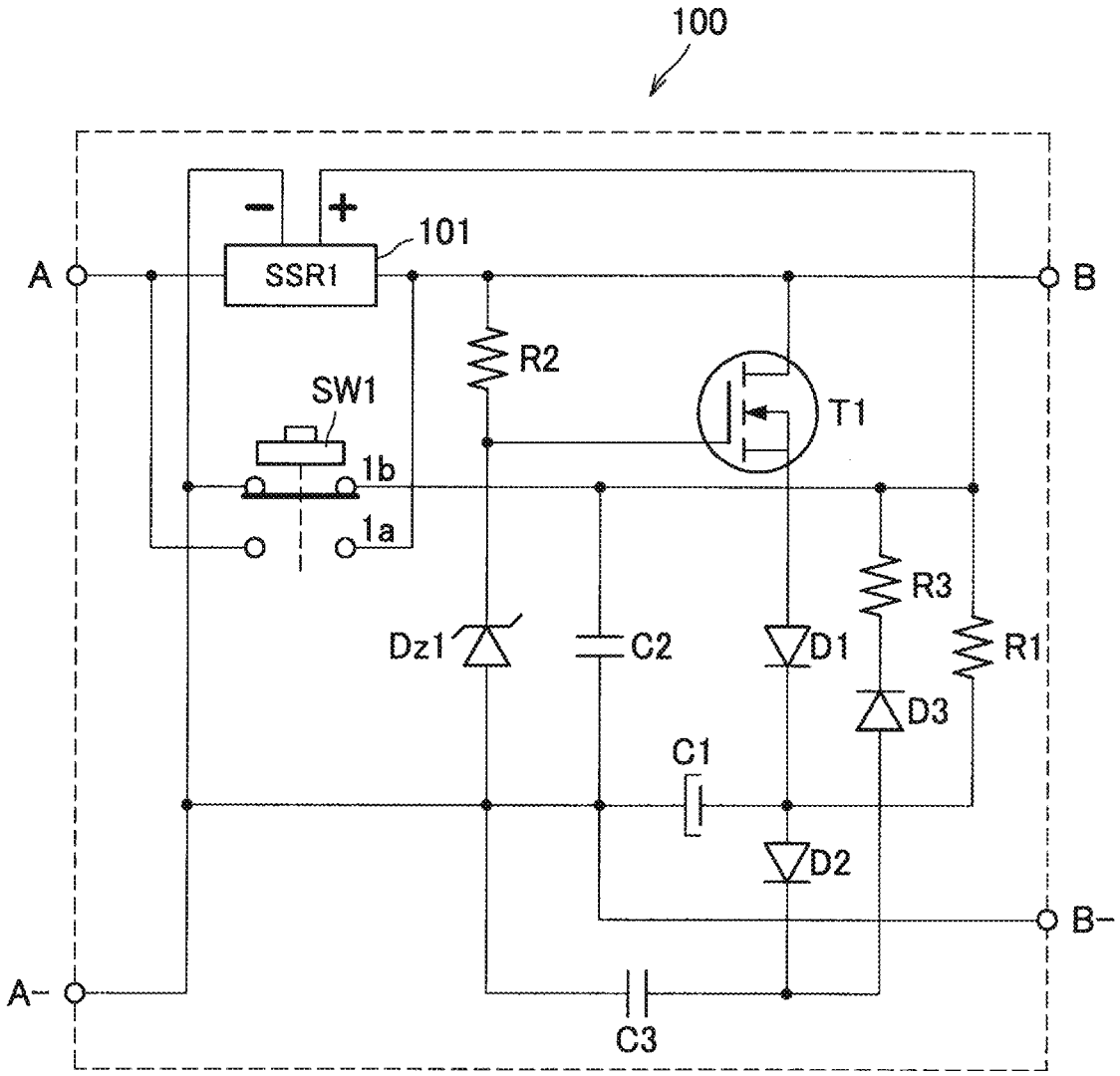
FIG. 33 is an explanatory view illustrating a configuration example of a switching device 100 according to an embodiment of the present disclosure.

FIG. 33 is an explanatory view illustrating a configuration example of a switching device 100 according to an embodiment of the present disclosure. The configuration example of the switching device 100 illustrated in FIG. 33 is a modification of the configuration of the switching device 100 illustrated in FIG. 24. Note that the switching device 100 illustrated in FIG. 33 operates in a manner similar to the manner shown in the timing chart illustrated in FIG. 25.

The switching device 100 illustrated in FIG. 33 includes an SSR 101, a switch SW1, diodes D1, D2, and D3, a Zener diode Dz1, capacitors C1 and C2, resistors R1, R2, and R3, and a MOSFET T1. The diode D3 illustrated in FIG. 33 is responsible for switching the time constant of an RC circuit provided in the SSR 101, when the contact 1*b* of the switch SW1 separates. That is, the diode D3 works to shorten the time constant by adding the resistor R3 to a filter of the resistor R1 and the capacitor C2, when the contact 1*b* of the switch SW1 separates. The diode D2 and the capacitor C3 form a circuit to supply power when the contact 1*b* of the switch SW1 separates.

Therefore, with the switching device 100 illustrated in FIG. 33, arcing can be inhibited even if the switch SW1 breaks the connection with the contacts 1*a* and 2*a*. Also, the switching device 100 illustrated in FIG. 33 can be connected in the same way as a typical relay, by having the number of terminals be four, and can thus be used in place of an existing relay.

Figure 34:
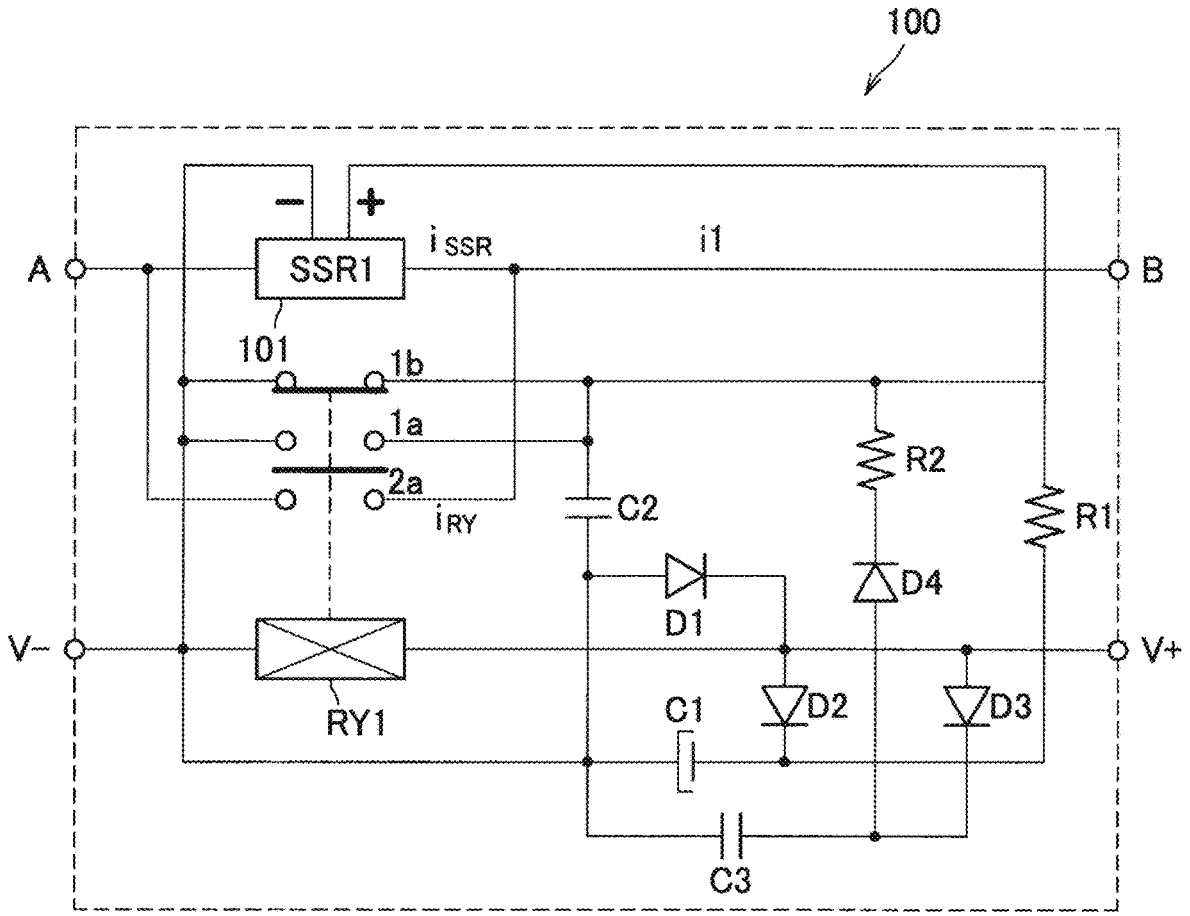
FIG. 34 is an explanatory view illustrating a configuration example of a switching device 100 according to an embodiment of the present disclosure.

FIG. 34 is an explanatory view illustrating a configuration example of a switching device 100 according to an embodiment of the present disclosure. The configuration example of the switching device 100 illustrated in FIG. 34 is a modification of the configuration of the switching device 100 illustrated in FIG. 27. Note that the switching device 100 illustrated in FIG. 34 operates in a manner similar to the manner shown in the timing chart illustrated in FIG. 28.

The switching device 100 illustrated in FIG. 34 includes an SSR 101, a mechanical relay RY1, diodes D1, D2, D3, and D4, capacitors C1, C2, and C3, and resistors R1 and R2. The switching device 100 illustrated in FIG. 34 switches the time constant of an RC circuit provided in the SSR 101, by adding the resistor R2 to a filter of the resistor R1 and the capacitor C2, in addition to the capacitor C2 and the resistor R1, when power stops being supplied to the mechanical relay RY1. That is, the switching device 100 illustrated in FIG. 34 shortens the time constant of the RC circuit by adding the resistor R2 to a filter of the resistor R1 and the capacitor C2, in addition to the capacitor C2 and the resistor R1, when power stops being supplied to the mechanical relay RY1. The diode D2 and the capacitor C3 form a circuit to supply power when the contact 1*b* of the switch SW1 separates. The diode D4 and the capacitor C3 form a circuit that stores power when power is no longer being supplied to the mechanical relay RY1.

Therefore, the switching device 100 illustrated in FIG. 34 is able to suppress arcing and absorb surges, even when current stops flowing from the terminal V+ to the terminal V−, and the mechanical relay RY1 breaks the connection with the contacts 1*a* and 2*a*. Also, the switching device 100 illustrated in FIG. 34 can be connected in the same way as a typical relay, by having the number of terminals be four, and can thus be used in place of an existing relay.

Also, the switching device 100 illustrated in FIG. 34 conducts electricity by only contact between the mechanical relay RY1 and the contact 2*a*, after the mechanical relay RY1 is driven and the contact switches such that the mechanical relay RY1 connects to the contacts 1*a* and 2*a*. At this time, even if the contact 2*a* of the mechanical relay RY1 has deteriorated due to an oxide film or the like, the mechanical relay RY1 displays a self-cleaning effect by a temporary spark that breaks down that film being generated at the contact 2*a*.

2. Summary

As described above, according to an embodiment of the present disclosure, a switching device is provided that suppresses arcing when switching between supplying and interrupting power, when an SSR and a mechanical relay are connected in parallel.

For example, according to an embodiment of the present disclosure, a switching device in which SSR is connected in parallel to a mechanical relay is provided. The switching device according to an embodiment of the present disclosure is able to suppress arcing that occurs upon separation of a contact of a mechanical relay, without chattering, which occurs upon connection of the contact of the mechanical relay, affecting the output of power, by connecting the SSR to the mechanical relay in parallel.

Also, the switching device according to an embodiment of the present disclosure is able to suppress arcing that occurs upon separation of the contact of the mechanical relay, without providing a delay circuit or the like that causes operation to be unstable, by connecting an SSR to a mechanical relay in parallel and appropriately controlling the timing at which the state of the SSR is switched, using a flip-flop circuit and a capacitor and the like.

Also, the switching device according to an embodiment of the present disclosure can also operate with four terminals, just like an existing relay. A switching device that is able to operate with four terminals by suppressing arcing when power is cut off while enabling operation with four terminals, can be used in place of an existing relay.

The preferred embodiment(s) of the present disclosure has/have been described above with reference to the accompanying drawings, whilst the present disclosure is not limited to the above examples. A person skilled in the art may find various alterations and modifications within the scope of the appended claims, and it should be understood that they will naturally come under the technical scope of the present disclosure.

Further, the effects described in this specification are merely illustrative or exemplified effects, and are not limitative. That is, with or in the place of the above effects, the technology according to the present disclosure may achieve other effects that are clear to those skilled in the art from the description of this specification.

Additionally, the present technology may also be configured as below.

(1)

A switching device including:

a semiconductor relay configured to switch between supplying and interrupting power from a power supply;

a mechanical relay configured to be connected in parallel to the semiconductor relay to switch between supplying and interrupting power from the power supply, and connected at one end to a control terminal of the semiconductor relay; and a switch configured to switch between supplying and interrupting current to the semiconductor relay, in which the semiconductor relay turns on by high voltage being applied to the control terminal after current flows through a coil of the mechanical relay and a contact is switched, and the semiconductor relay turns off by low voltage being applied to the control terminal after current stops flowing through the coil of the mechanical relay and the contact is switched.

(2)

The switching device according to (1), further including:

a first flip-flop circuit configured to control operation of the mechanical relay; and a second flip-flop circuit configured to output high or low voltage to the control terminal of the semiconductor relay, in which the second flip-flop circuit inverts the output to the control terminal of the semiconductor relay after current has stopped flowing through the coil of the mechanical relay due to the first flip-flop circuit.

(3)

The switching device according to (2), in which inverted output of the first flip-flop circuit is output to the second flip-flop circuit.

(4)

The switching device according to any of (1) to (3), in which the power supply is a direct-current power supply.

(5)

The switching device according to any of (1) to (4), in which the mechanical relay is an automatic reset relay.

(6)

The switching device according to any of (1) to (4), in which the mechanical relay is a latching relay.

(7)

A switching device including:

a first semiconductor relay configured to switch between supplying and interrupting power from a first power supply;

a second semiconductor relay configured to switch between supplying and interrupting power from a second power supply;

a first mechanical relay configured to be connected in parallel to the first semiconductor relay to switch between supplying and interrupting power from the first power supply;

a second mechanical relay configured to be connected in parallel to the second semiconductor relay to switch between supplying and interrupting power from the second power supply;

a first flip-flop circuit configured to control operation of the first mechanical relay and the second mechanical relay; and a second flip-flop circuit configured to output high or low voltage to a control terminal of the first semiconductor relay and a control terminal of the second semiconductor relay, in which after current has stopped flowing to one of the first mechanical relay or the second mechanical relay, the first flip-flop circuit passes current to the other, and the second flip-flop circuit inverts output to the control terminal of the first semiconductor relay and the control terminal of the second semiconductor relay after current has stopped flowing to one of the first mechanical relay or the second mechanical relay.

(8)

The switching device according to (7), in which a signal from an opposing break contact is input to the first flip-flop circuit in a case where the first mechanical relay or the second mechanical relay is off.

(9)

The switching device according to (7) or (8), in which the second flip-flop circuit feeds back output to output of the first flip-flop circuit, and the first flip-flop circuit receives the output of the second flip-flop circuit and passes current to the other of the first mechanical relay or the second mechanical relay, to which current has stopped flowing.

(10)

A switching device including:

a first semiconductor relay configured to switch between supplying and interrupting power from a first alternating-current power supply;

a second semiconductor relay configured to switch between supplying and interrupting power from a second alternating-current power supply;

a first mechanical relay configured to be connected in parallel to the first semiconductor relay to switch between supplying and interrupting power from the first alternating-current power supply;

a second mechanical relay configured to be connected in parallel to the second semiconductor relay to switch between supplying and interrupting power from the second alternating-current power supply;

a first flip-flop circuit configured to control operation of the first mechanical relay and the second mechanical relay;

a second flip-flop circuit configured to output high or low voltage to a control terminal of the first semiconductor relay and a control terminal of the second semiconductor relay;

a first trigger circuit configured to generate a first trigger signal using output of the first alternating-current power supply; and a second trigger circuit configured to generate a second trigger signal using output of the second alternating-current power supply, in which after current has stopped flowing to one of the first mechanical relay or the second mechanical relay, the first flip-flop circuit passes current to the other, and the second flip-flop circuit feeds back output to output of the first flip-flop circuit, and inverts output to the control terminal of the first semiconductor relay and the control terminal of the second semiconductor relay on the basis of the first trigger signal or the second trigger signal, after current has stopped flowing to one of the first mechanical relay or the second mechanical relay and current flows to the other.

(11)

The switching device according to (10), in which the first trigger circuit and the second trigger circuit generate the first trigger signal and the second trigger signal, respectively, at a timing at which the first alternating-current power supply and the second alternating-current power supply become equal to or less than a predetermined first threshold voltage and a timing at which the first alternating-current power supply and the second alternating-current power supply exceed a second threshold voltage that is lower than the first threshold voltage.

(12)

The switching device according to (11), in which the first trigger circuit and the second trigger signal also generate a third trigger signal and a fourth trigger signal, respectively, at a timing at which the first alternating-current power supply and the second alternating-current power supply exceed the first threshold voltage and a timing at which the first alternating-current power supply and the second alternating-current power supply become equal to or less than the second threshold voltage, and the switching device further includes a first NAND gate configured to output NAND of the output of the second flip-flop circuit and the third trigger signal to the first flip-flop circuit, and a second NAND gate configured to output NAND of the output of the second flip-flop circuit and the fourth trigger signal to the first flip-flop circuit.

(13)

A switching device including:

a semiconductor relay configured to switch between supplying and interrupting power from a power supply;

a mechanical relay configured to be connected in parallel to the semiconductor relay to switch between supplying and interrupting power from the power supply; and a capacitor configured to be connected in parallel to the mechanical relay and connected at one end to a control terminal of the semiconductor relay, in which the semiconductor relay turns on by high voltage being applied to the control terminal before the mechanical relay switches from off to on, and the semiconductor relay turns off by low voltage being applied to the control terminal after the mechanical relay has switched from on to off, and the capacitor stores power while the mechanical relay is on, and the capacitor outputs power to keep the semiconductor relay on after the mechanical relay has switched off.

(14)

The switching device according to (13), further including:

a flip-flop circuit configured to output high or low voltage to the control terminal of the semiconductor relay.

(15)

The switching device according to (13) or (14), in which the mechanical relay is an automatic reset relay.

(16)

The switching device according to (13) or (14), in which the mechanical relay is a manual reset relay.

(17)

The switching device according to (13), in which energization through the semiconductor relay starts when the off state of the mechanical relay is canceled, and the energization switches to energization only through the mechanical relay when the mechanical relay switches on after a predetermined period of time has passed after the off state is canceled.

(18)

The switching device according to any of (13) to (17), in which when the state of the mechanical relay switches, a time constant of an RC circuit provided upstream of the semiconductor relay is changed.

(19)

A switching device including:

a semiconductor relay configured to switch between supplying and interrupting power from a first power supply;

a first self-holding mechanical relay configured to be connected in parallel to the semiconductor relay to switch between supplying and interrupting power from the first power supply, and connected at one end to a control terminal of the semiconductor relay;

a second self-holding mechanical relay configured to switch between supplying and interrupting power from a second power supply;

a switch configured to control the supply and interruption of power to the first self-holding mechanical relay and the second self-holding mechanical relay; and timing adjustment circuits configured to be provided between the switch and the first and second self-holding mechanical relays, in which the timing adjustment circuits adjust a timing such that the second self-holding mechanical relay, the semiconductor relay, and the first self-holding mechanical relay turn on in a case where the supply of power from the first power supply and the second power supply starts in response to operation of the switch, and the first self-holding mechanical relay, the semiconductor relay, and the second self-holding mechanical relay turn off in a case where the supply of power from the first power supply and the second power supply is stopped in response to operation of the switch.

(20)

The switching device according to (18), in which the timing adjustment circuits switch time constants of a first RC circuit provided upstream of the first self-holding mechanical relay and a second RC circuit provided upstream of the second self-holding mechanical relay, when the supply of power from the first power supply and the second power supply starts or stops in response to operation of the switch.

(21)

A mobile object including: the switching device according to any of (1) to (20).

(22)

A power supply system including:

a battery configured to supply direct-current power;

a drive unit configured to be driven by the direct-current power supplied from the battery; and at least one of the switching device according to any of (1) to (20), provided between the battery and the drive unit.

REFERENCE SIGNS LIST

100 switching device
111 inverter
112 inverter
121 inverter
122 inverter
131 inverter
132 inverter
133 AND gate
141 NAND gate
142 NAND gate
151 trigger signal generating unit
152 trigger signal generating unit
153 NAND gate
154 NAND gate
RSFF1 RS flip-flop circuit
RSFF2 RS flip-flop circuit
RY1 mechanical relay
RY2 mechanical relay
SW1 switch

The invention claimed is:

1. A switching device comprising:

a semiconductor relay configured to switch between supplying and interrupting power from a power supply;

a mechanical relay configured to be connected in parallel to the semiconductor relay to switch between supplying and interrupting power from the power supply, and connected at one end to a control terminal of the semiconductor relay;

a switch configured to switch between supplying and interrupting current to the semiconductor relay;

a first flip-flop circuit configured to control operation of the mechanical relay; and a second flip-flop circuit configured to output high or low voltage to the control terminal of the semiconductor relay, wherein the second flip-flop circuit inverts the output to the control terminal of the semiconductor relay after current has stopped flowing through a coil of the mechanical relay due to the first flip-flop circuit, and wherein the semiconductor relay turns on by high voltage being applied to the control terminal after current flows through the coil of the mechanical relay and a contact is switched, and the semiconductor relay turns off by low voltage being applied to the control terminal after current stops flowing through the coil of the mechanical relay and the contact is switched.

2. The switching device according to claim 1, wherein inverted output of the first flip-flop circuit is output to the second flip-flop circuit.

3. The switching device according to claim 1, wherein the power supply is a direct-current power supply.

4. The switching device according to claim 1, wherein the mechanical relay is an automatic reset relay.

5. The switching device according to claim 1, wherein the mechanical relay is a latching relay.

6. A switching device comprising:

a first semiconductor relay configured to switch between supplying and interrupting power from a first power supply;

a second semiconductor relay configured to switch between supplying and interrupting power from a second power supply;

a first mechanical relay configured to be connected in parallel to the first semiconductor relay to switch between supplying and interrupting power from the first power supply;

a second mechanical relay configured to be connected in parallel to the second semiconductor relay to switch between supplying and interrupting power from the second power supply;

a first flip-flop circuit configured to control operation of the first mechanical relay and the second mechanical relay; and a second flip-flop circuit configured to output high or low voltage to a control terminal of the first semiconductor relay and a control terminal of the second semiconductor relay, wherein after current has stopped flowing to one of the first mechanical relay or the second mechanical relay, the first flip-flop circuit passes current to the other, and the second flip-flop circuit inverts output to the control terminal of the first semiconductor relay and the control terminal of the second semiconductor relay after current has stopped flowing to one of the first mechanical relay or the second mechanical relay.

7. The switching device according to claim 6, wherein a signal from an opposing break contact is input to the first flip-flop circuit in a case where the first mechanical relay or the second mechanical relay is off.

8. The switching device according to claim 6, wherein the second flip-flop circuit feeds back output to output of the first flip-flop circuit, and the first flip-flop circuit receives the output of the second flip-flop circuit and passes current to the other of the first mechanical relay or the second mechanical relay, to which current has stopped flowing.

9. A switching device comprising:

a first semiconductor relay configured to switch between supplying and interrupting power from a first alternating-current power supply;

a second semiconductor relay configured to switch between supplying and interrupting power from a second alternating-current power supply;

a first mechanical relay configured to be connected in parallel to the first semiconductor relay to switch between supplying and interrupting power from the first alternating-current power supply;

a second mechanical relay configured to be connected in parallel to the second semiconductor relay to switch between supplying and interrupting power from the second alternating-current power supply;

a first flip-flop circuit configured to control operation of the first mechanical relay and the second mechanical relay;

a second flip-flop circuit configured to output high or low voltage to a control terminal of the first semiconductor relay and a control terminal of the second semiconductor relay;

a first trigger circuit configured to generate a first trigger signal using output of the first alternating-current power supply; and a second trigger circuit configured to generate a second trigger signal using output of the second alternating-current power supply, wherein after current has stopped flowing to one of the first mechanical relay or the second mechanical relay, the first flip-flop circuit passes current to the other, and the second flip-flop circuit feeds back output to output of the first flip-flop circuit, and inverts output to the control terminal of the first semiconductor relay and the control terminal of the second semiconductor relay on the basis of the first trigger signal or the second trigger signal, after current has stopped flowing to one of the first mechanical relay or the second mechanical relay and current flows to the other.

10. The switching device according to claim 9, wherein the first trigger circuit and the second trigger circuit generate the first trigger signal and the second trigger signal, respectively, at a timing at which the first alternating-current power supply and the second alternating-current power supply become equal to or less than a predetermined first threshold voltage and a timing at which the first alternating-current power supply and the second alternating-current power supply exceed a second threshold voltage that is lower than the first threshold voltage.

11. The switching device according to claim 10, wherein the first trigger circuit and the second trigger signal also generate a third trigger signal and a fourth trigger signal, respectively, at a timing at which the first alternating-current power supply and the second alternating-current power supply exceed the first threshold voltage and a timing at which the first alternating-current power supply and the second alternating-current power supply become equal to or less than the second threshold voltage, and the switching device further comprises a first NAND gate configured to output NAND of the output of the second flip-flop circuit and the third trigger signal to the first flip-flop circuit, and a second NAND gate configured to output NAND of the output of the second flip-flop circuit and the fourth trigger signal to the first flip-flop circuit.

12. A switching device comprising:

a semiconductor relay configured to switch between supplying and interrupting power from a power supply;

a mechanical relay configured to be connected in parallel to the semiconductor relay to switch between supplying and interrupting power from the power supply; and a capacitor configured to be connected in parallel to the mechanical relay and connected at one end to a control terminal of the semiconductor relay, wherein the semiconductor relay turns on by high voltage being applied to the control terminal before the mechanical relay switches from off to on, and the semiconductor relay turns off by low voltage being applied to the control terminal after the mechanical relay has switched from on to off, and the capacitor stores power while the mechanical relay is on, and the capacitor outputs power to keep the semiconductor relay on after the mechanical relay has switched off.

13. The switching device according to claim 12, further comprising:

a flip-flop circuit configured to output high or low voltage to the control terminal of the semiconductor relay.

14. The switching device according to claim 12, wherein the mechanical relay is an automatic reset relay.

15. The switching device according to claim 12, wherein the mechanical relay is a manual reset relay.

16. The switching device according to claim 12, wherein energization through the semiconductor relay starts when the off state of the mechanical relay is canceled, and the energization switches to energization only through the mechanical relay when the mechanical relay switches on after a predetermined period of time has passed after the off state is canceled.

17. The switching device according to claim 12, wherein when the state of the mechanical relay switches, a time constant of an RC circuit provided upstream of the semiconductor relay is changed.

18. A switching device comprising:

a semiconductor relay configured to switch between supplying and interrupting power from a first power supply;

a first self-holding mechanical relay configured to be connected in parallel to the semiconductor relay to switch between supplying and interrupting power from the first power supply, and connected at one end to a control terminal of the semiconductor relay;

a second self-holding mechanical relay configured to switch between supplying and interrupting power from a second power supply;

a switch configured to control the supply and interruption of power to the first self-holding mechanical relay and the second self-holding mechanical relay; and timing adjustment circuits configured to be provided between the switch and the first and second self-holding mechanical relays, wherein the timing adjustment circuits adjust a timing such that the second self-holding mechanical relay, the semiconductor relay, and the first self-holding mechanical relay turn on in a case where the supply of power from the first power supply and the second power supply starts in response to operation of the switch, and the first self-holding mechanical relay, the semiconductor relay, and the second self-holding mechanical relay turn off in a case where the supply of power from the first power supply and the second power supply is stopped in response to operation of the switch.

19. The switching device according to claim 18, wherein the timing adjustment circuits switch time constants of a first RC circuit provided upstream of the first self-holding mechanical relay and a second RC circuit provided upstream of the second self-holding mechanical relay, when the supply of power from the first power supply and the second power supply starts or stops in response to operation of the switch.

20. A mobile object comprising:

the switching device according to claim 1.

21. A power supply system comprising:

a battery configured to supply direct-current power;

a drive unit configured to be driven by the direct-current power supplied from the battery; and at least one of the switching device according to claim 1, provided between the battery and the drive unit.

* * * * *